US012274371B2

(12) United States Patent
Ejnes

(10) Patent No.: US 12,274,371 B2
(45) Date of Patent: Apr. 15, 2025

(54) FOLDING CHAIR WITH MULTIPLE MODES

(71) Applicant: Mark Ejnes, Santa Monica, CA (US)

(72) Inventor: Mark Ejnes, Santa Monica, CA (US)

( * ) Notice: Subject to any disclaimer, the term of this patent is extended or adjusted under 35 U.S.C. 154(b) by 117 days.

(21) Appl. No.: 18/348,066

(22) Filed: Jul. 6, 2023

(65) Prior Publication Data

US 2025/0009132 A1 Jan. 9, 2025

(51) Int. Cl.

| | |
|---|---|
| ***A47C 1/028*** | (2006.01) |
| ***A47C 4/04*** | (2006.01) |
| ***A47C 4/10*** | (2006.01) |
| ***A47C 4/12*** | (2006.01) |
| ***A47C 4/20*** | (2006.01) |
| ***A47C 4/28*** | (2006.01) |
| ***A47C 4/34*** | (2006.01) |
| ***A47C 4/44*** | (2006.01) |
| ***A47C 7/14*** | (2006.01) |
| ***A47C 7/54*** | (2006.01) |

(52) U.S. Cl.

CPC ..... *A47C 4/04* (2013.01); *A47C 1/028* (2013.01); *A47C 4/10* (2013.01); *A47C 4/12* (2013.01); *A47C 4/20* (2013.01); *A47C 4/28* (2013.01); *A47C 4/34* (2013.01); *A47C 4/44* (2013.01); *A47C 7/144* (2018.08); *A47C 7/541* (2018.08)

(58) Field of Classification Search

CPC .. A47C 4/04; A47C 1/028; A47C 4/10; A47C 4/12; A47C 4/20; A47C 4/28; A47C 4/34; A47C 4/44; A47C 7/144; A47C 7/541

USPC ..... 297/1, 16.1, 16.2, 19, 92, 118, 283.2

See application file for complete search history.

(56) References Cited

U.S. PATENT DOCUMENTS

| | | | | | |
|---|---|---|---|---|---|
| 921,466 | A * | 5/1909 | Ruehs | A47C 1/143 | 297/19 |
| 1,265,848 | A * | 5/1918 | Wheeler | A47C 19/122 | 297/118 |
| 2,541,131 | A * | 2/1951 | Thal | A47C 4/10 | 297/47 |
| 2,674,302 | A * | 4/1954 | McMorran, Jr. | A47C 1/028 | 297/447.4 |
| 3,005,659 | A * | 10/1961 | Billy | A47C 4/12 | 297/51 |
| 6,698,828 | B1 * | 3/2004 | Chan | A47C 4/10 | 297/53 |
| 7,103,927 | B2 * | 9/2006 | Holub | A47C 17/70 | 5/112 |

(Continued)

*Primary Examiner* — Robert Canfield
(74) *Attorney, Agent, or Firm* — Zhong Law, LLC

(57) ABSTRACT

A folding chair with multiple modes may include a first frame and a second frame rotatably connected by a joint assembly, a first support arranged in the first frame and a second support arranged in the second frame and six legs. The six legs may include a first pair of legs rotatably attached to the second frame, a second pair of legs rotatably attached to the first frame (e.g., via another joint assembly), and a third pair of legs rotatably attached to the second frame. The folding chair may further include a pair of armrests rotatably attached to the joint assembly. The multiple modes of the folding chair may include a first mode wherein the folding chair is configured as a dining chair, a second mode wherein the folding chair is configured as a lounging chair and a third mode wherein the folding chair is configured for compact storage.

20 Claims, 24 Drawing Sheets

(56) References Cited

U.S. PATENT DOCUMENTS

| | | | | |
|---|---|---|---|---|
| 7,387,332 | B2 * | 6/2008 | Piretti | A47C 1/028 297/118 |
| 10,238,214 | B1 * | 3/2019 | Haythornthwaite | A45F 4/02 |
| 2002/0125744 | A1 * | 9/2002 | Tseng | A47C 4/14 297/16.1 |
| 2016/0198857 | A1 * | 7/2016 | Grace | A47C 17/70 297/16.2 |
| 2025/0000263 | A1 * | 1/2025 | Lu | A47C 7/541 |

* cited by examiner

FIG. 20A
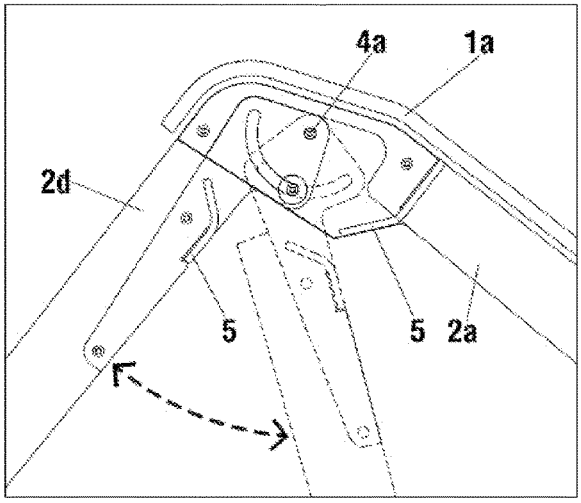
FIG. 20B
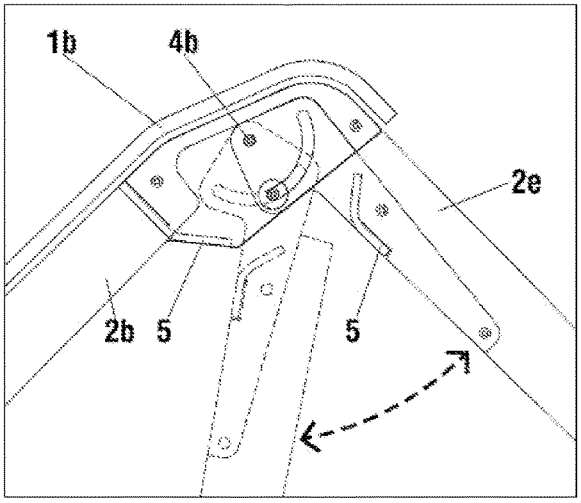
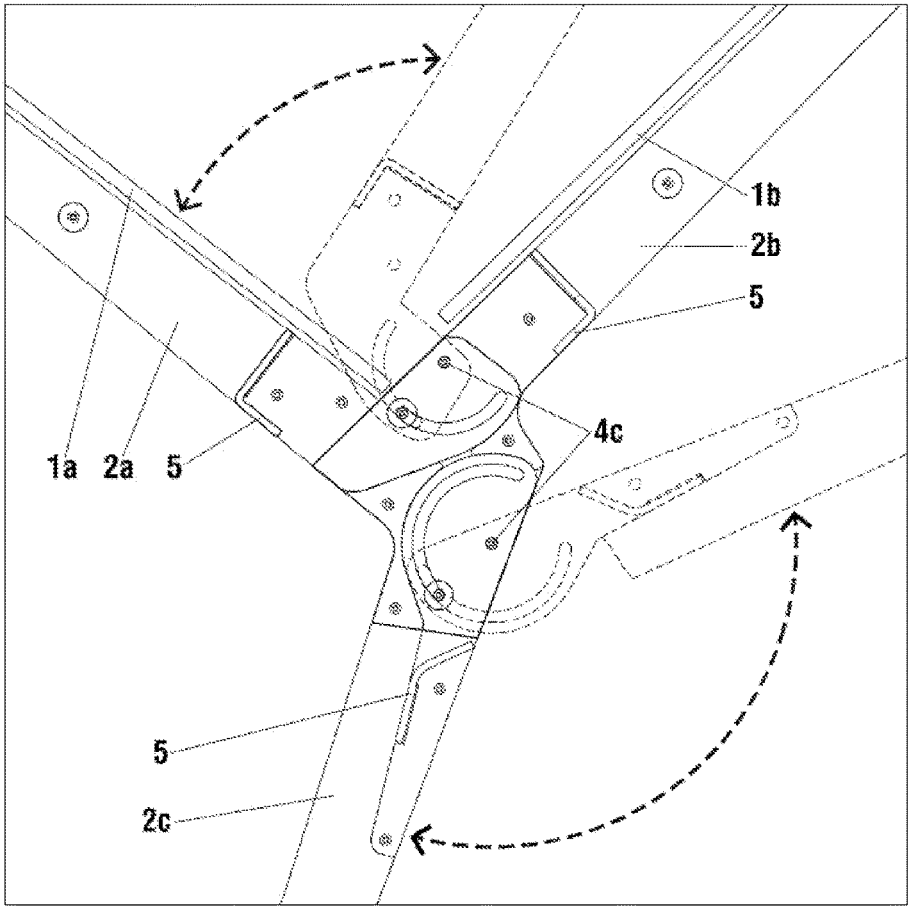
FIG. 20C

FOLDING CHAIR WITH MULTIPLE MODES

TECHNICAL FIELD

The present disclosure relates generally to furniture in the form of a folding chair. More specifically the disclosure relates to a folding chair that converts between multiple modes for storage and for providing different seating options to a user.

BACKGROUND

Furniture in the form of a folding chair (e.g., a portable chair that folds to a smaller size and can be stored in a stack or in a row) may generally include a seat; a backrest (e.g., a high backrest in case of a dining/office chair); possible armrests; a base; and, occasionally, a system for tilting the backrest into a more/less inclined position. The folding chair may often have to meet minimum functional and/or ergonomic requirements based on the intended mode of operation (e.g., type of seating provided) as well as being able to fold into a smaller form.

For example, a "dining" chair commonly utilizes certain proportions for its legs relative to the seat and backrest in order to allow a user to comfortably sit upright at a typically proportioned dining table or desk. The dining chair may share similar proportions with other chairs that may commonly be referred to as "desk" chairs, "office" chairs, "accent" chairs', etc. On the other hand, a "lounge" chair commonly utilizes certain proportions for the legs that allow the seat and backrest to be closer to the ground and also tilted backward relative to other seating types such as the above-mentioned dining chairs, in order to provide a more leisurely, reclining position for the sitter. The lounge chair may share similar proportions to other chairs that may commonly be referred to as "deck" chairs, "adirondack" chairs, "beach" chairs, etc. and are typically used alongside other "lounge" furniture such as sofas, coffee tables, firepits, etc.

BRIEF DESCRIPTION OF THE DRAWINGS

In the drawings, which are not necessarily drawn to scale, like numerals may describe similar components in different views. Like numerals having different letter suffixes may represent different instances of similar components. Some embodiments are illustrated by way of example, and not limitation, in the figures of the accompanying drawings.

FIGS. 20A-20C show side views of the rotatable connections between elements of the folding chair, consistent with some embodiments described herein.

DETAILED DESCRIPTION

Some existing dining chairs (e.g., with or without armrests) may also be folding chairs and some existing lounge chairs (e.g., with or without armrests) may be folding chairs as well. Furthermore, some existing folding chairs (e.g., of all types) may be modular in design, however the multi-mode folding chair described herein combines all of these functions and/or characteristics into one convertible chair. As noted above, the type of furniture discussed herein (e.g., a folding chair) may operate according to multiple different modes. For example, the chair may convert from a dining chair in a first mode of operation into a lounge chair when configured in a second mode of operation. The folding chair may also function as an "arm" chair (e.g., including armrests) as well as folding into a smaller size for storage/transport purposes. Such a multi-mode folding chair may provide two (or more) different commonly used seating modes in one easy-to-convert chair that may also be folded for more efficient storage and/or easier transport and still further may also be used outdoors as easily as indoors based on different materials (e.g., waterproof) being used for any of the easily interchangeable modular components (e.g., as described below). Accordingly, the configurable structure of the folding chair described herein may address many of the unsolved challenges (e.g., functional and ergonomic) facing such convertible chair structures.

Figure 1:
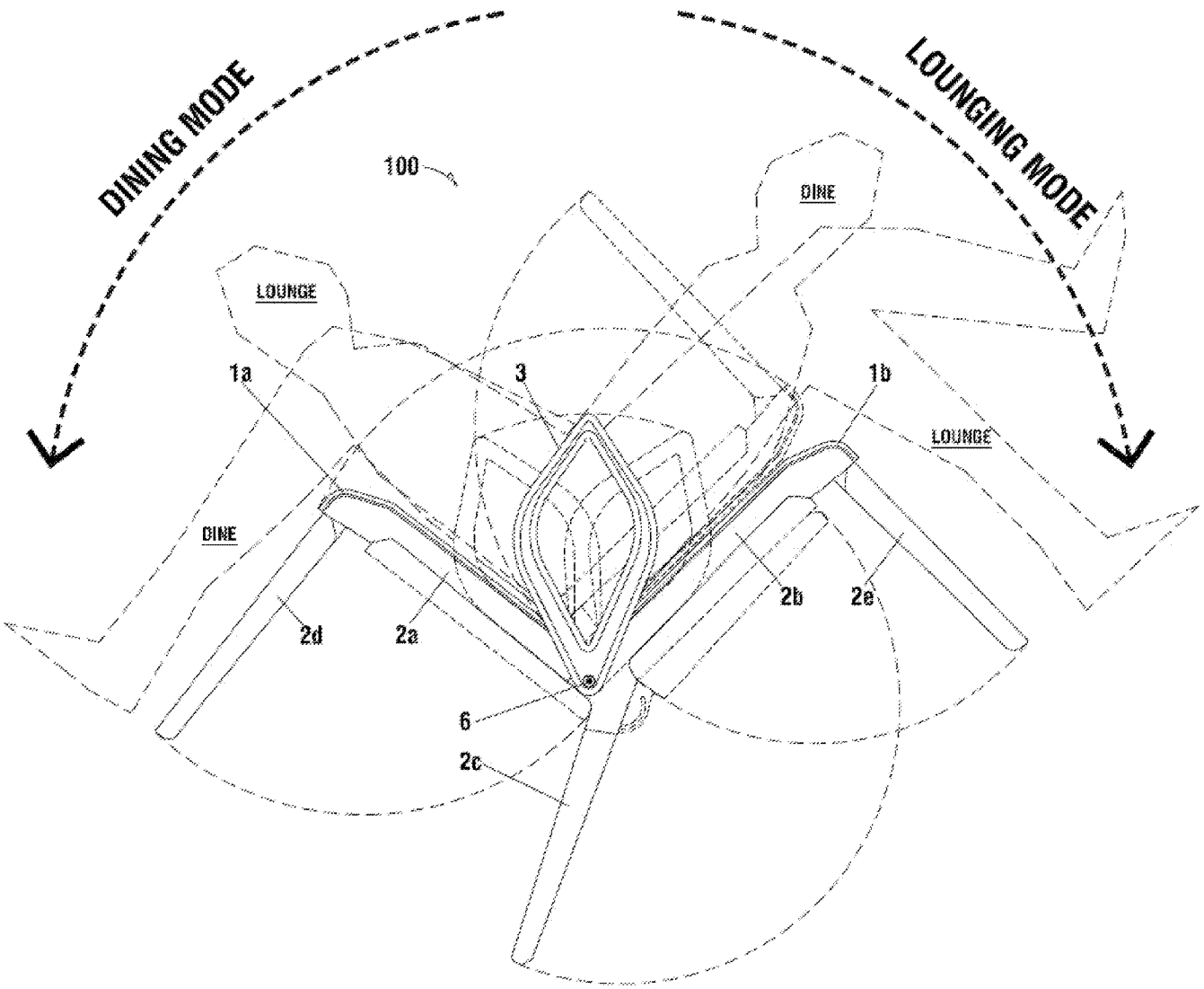
FIG. 1 shows a side view of a folding chair, consistent with some embodiments described herein, illustrating a range of rotation of component parts.

FIG. 1 shows a side view of a folding chair 100, consistent with some embodiments described herein, illustrating a range of rotation of component parts.

The folding chair 100 may include a pair of identical (and interchangeable as explained more fully below) supports (e.g., a first support 1*a* and a second support 1*b*) that may each be arranged within one of a pair of frames (e.g., a first frame 2*a* and a second frame 2*b*). The first frame 2*a* and the second frame 2*b* may be rotatably connected to each other via a joint assembly (e.g., joint assemblies 4*c* described below with respect to FIG. 2). For example, the first support 1*a* may be removably or fixedly arranged within the first frame 2*a* and the second support 1*b* may be removably or fixedly arranged within the second frame 2*b*. The supports 1*a*, 1*b* may serve as the seat or backrest interchangeably either in the dining chair mode or in the lounge chair mode.

In some embodiments, a pair of armrests 3 may each be attached to a joint assembly 4*c* on opposite sides via a pair of hinged connections 6. The folding chair 100 may also include six legs (e.g., leg pairs 2*c*, 2*d* and 2*e*) that may rotate and lock into various different positions so that a configuration of the folding chair 100 may convert from a first mode wherein folding chair 100 is configured with typical dining chair proportions (e.g., shown as "Dining Mode") to a second mode wherein the folding chair 100 is configured with typical lounge chair proportions (e.g., shown as "Lounging Mode") as well as a third mode (e.g., a "Storage Mode" shown more fully in FIGS. 17 and 18) for folding into a configuration with smaller storage/transport proportions.

As noted above, the folding chair 100 may include six legs: a first pair of back legs 2*c* that may be deployed according to the first mode for dining or according to the second mode for lounging, a second pair of longer front legs 2*d* that may be deployed according to the first mode for dining and retracted (e.g., folded into recess areas in the first frame 2*a* or folded adjacent to second frame 2*a*) according to the second mode for lounging, and a third pair of shorter front legs 2*e* that may be deployed according to the second mode for lounging and retracted (e.g., folded into recess areas in the second frame 2*b* or folded adjacent to second frame 2*b*) according to the first mode for dining. All six legs (e.g., pairs 2*c*, 2*d* and 2*e*) may be retracted (e.g., folded into recess areas in the first frame 2*a* and/or the second frame 2*b*) for the third mode (e.g., storage mode). Furthermore, in some embodiments, the first pair of legs 2*c* may each have an identical first length, the second pair of legs 2*d* may each have an identical second length, and the third pair of legs 2*e* may each have an identical third length, wherein the second length may be greater than the third length.

In some embodiments, the first and second frames 2*a* and 2*b*, the first and second supports 1*a* and 1*b*, and the pairs of legs 2*c*-2*e* may be made of same or different materials including wood, metal, plastic or other such materials (e.g., solid materials). In some embodiments, the first and second supports 1*a* and 1*b* may be made of more flexible materials (e.g., made of fabric or leather slings) than the frames 2*a*-2*b* and the legs 2*c*-2*e*.

As noted above, the folding chair 100 may include a pair of frames 2*a* and 2*b* wherein the first frame 2*a* may contain the first support 1*a* (e.g., arranged within the frame as a seat) in the first mode (e.g., the Dining Mode) at an angle that is appropriately sloped for comfortable sitting while dining/working and may also contain the first support 1*a* (e.g., arranged within the frame as a backrest) in the second mode (e.g., the Lounging Mode) at an angle that is appropriately sloped for sitting while in a more reclined lounging position. Furthermore, the second frame 2*b* may contain the support 1*b* (e.g., arranged within the frame as a backrest) in the first mode for dining/working at an angle that is appropriately sloped for comfortable sitting and may also contain the support 1*b* (e.g., arranged within the frame as a seat) in the second mode for lounging at an angle that is appropriately sloped for the more reclined lounging position.

Figure 2:
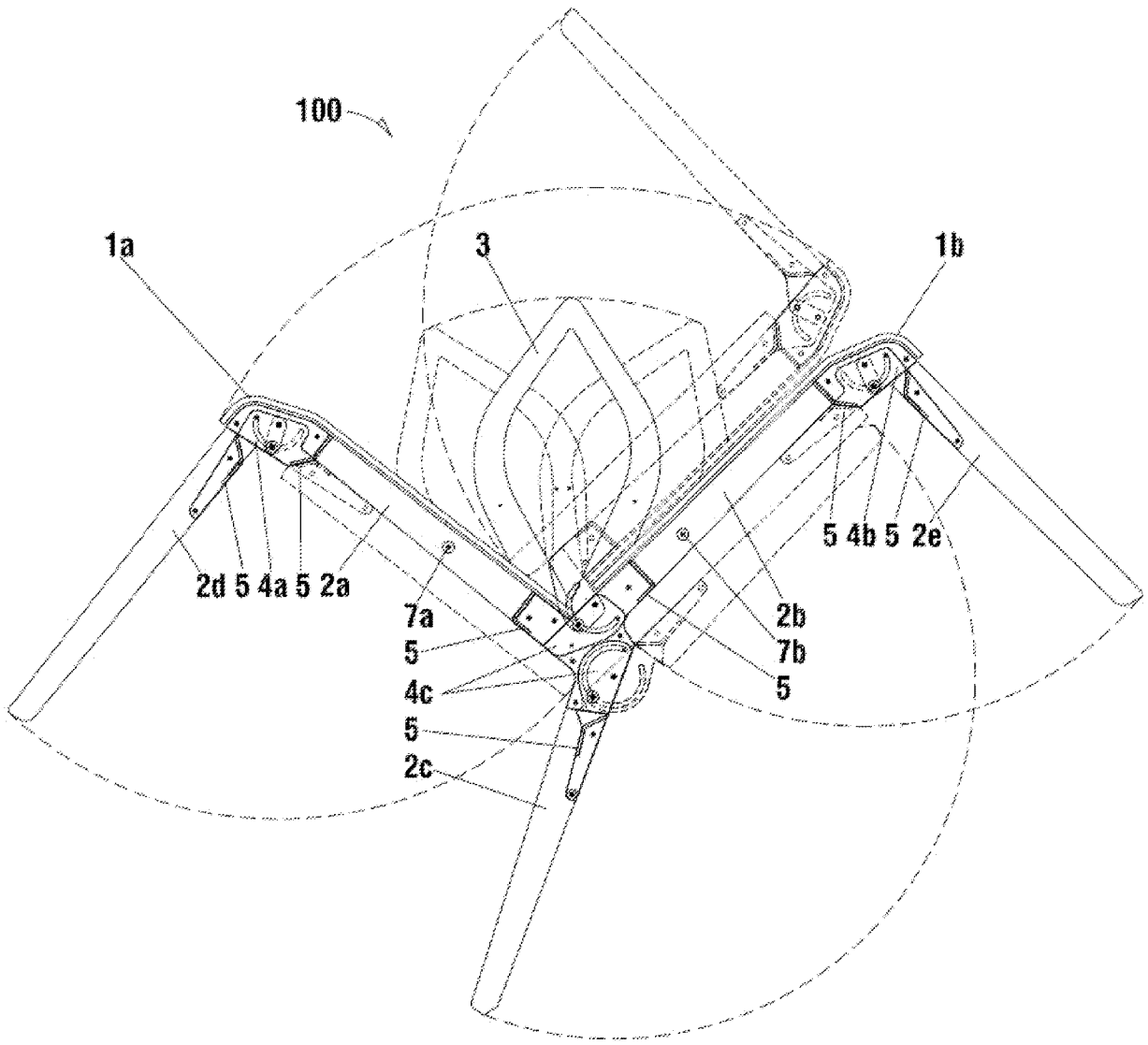
FIG. 2 shows a section view of the folding chair, consistent with some embodiments described herein, illustrating the range of rotation of component parts.

FIG. 2 shows a section view of the folding chair 100, consistent with some embodiments described herein, illustrating the range of rotation of component parts.

As noted above, the frames 2*a* and 2*b* may be connected to each other via a joint assembly 4*c* (e.g., made of metal, plastic or other such materials) which may be rotated and locked. Joint assembly 4*c* can facilitate configuring (e.g., and then locking) the frames 2*a* and 2*b* into different positions that allow for the folding chair 100 to be respectively configured for the various modes of operation such as for dining, lounging or storage (e.g., the first and second frames 2*a* and 2*b* may fold in towards each other in the third mode for storage). Furthermore, the first, second and third pairs of legs 2*c*, 2*d*, and 2*e* may also be rotatably attached (e.g., via a number of joint assemblies 4*a*-4*c* or other such connections) to the second frame 2*b* via 4*c*, the first frame 2*a* via 4*a*, and the second frame 2*b* via 4*b*, respectively, where the joint assemblies 4*a*-4*c* can be different types or same type of joint assemblies.

The various deployments of the pairs of legs allow for the pair of supports 1*a* and 1*b* and their associated frames 2*a* and 2*b* to be positioned in different orientations according to the configurations associated with the different modes of operation as explained more fully below with respect to the following figures. For example, the first support 1*a* that serves as a chair seat in the first mode for dining may also serve as a chair backrest in the second mode for lounging, and likewise, the second support 1*b* that serves as a chair backrest in the first mode for dining may serve as chair seat in the second mode for lounging. Accordingly, the deployment of the pairs of legs (e.g., 2*c*, 2*d*, and 2*e*) into different positions may allow for the folding chair 100 to be respectively configured for the various modes of operation such as the first mode for dining, the second mode for lounging or the third mode for storage.

In some embodiments, the first and second frames 2*a* and 2*b* as well as each of the pairs of legs 2*c*, 2*d* and 2*e* of the folding chair 100 may include various cross members 5 (e.g., made of metal, wood, plastic or other such materials) that may provide lateral bracing to the frames and/or to the pairs of legs 2*c*, 2*d* and 2*e* and may also function as compression members to counteract the forces that supports 1*a* and 1*b* (e.g., when being made of fabric or leather slings)

may enact on the frames 2*a* and 2*b* and/or on the pairs of legs 2*c*, 2*d* and 2*e*. In some embodiments, the cross members 5 may be integrated with the joint assemblies 4*a*, 4*b* (and/or the other rotatable connections mentioned above with respect to the pairs of legs) or alternatively they may be implemented as separate entities from the joint assembly 4*a*, 4*b* and/or other rotatable connections. In some embodiments, legs 2*c*, 2*d*, and 2*e* may include crossmembers 5.

In some embodiments, the pair of armrests 3 may be made of wood, metal, plastic, rubber or other such materials. As noted above with respect to FIG. 1, the armrests 3 may be attached to the joint assembly 4*c* at opposite sides with respective hinged connections 6. The armrests 3 may then be locked into position with respect to the first frame 2*a* or the second frame 2*b* via respective pairs of locking mechanisms 7*a* and 7*b*. The design of the armrests 3 may provide for a leaf-like shape (as shown in FIG. 1 and FIG. 2) that works for both the first "dining" mode and the second "lounging" mode as appropriately proportioned forearm supports when rotated via hinges 6 and then locked into the appropriate positions with respect to the first and second frames 2*a* and 2*b*, respectively, with each of the locking mechanisms 7*a* on opposite sides of frame 2*a* or with each of the locking mechanisms 7*b* on opposite sides of frame 2*b*. For example, in the first mode for dining, the armrests 3 may provide horizontal resting surfaces for the dining sitter's forearms that are level with the floor and are also positioned at a comfortable height. Likewise, the same armrests 3, when rotated and locked according to the configuration for the second mode, may also provide horizontal resting surfaces for the lounging sitter's forearms that are also level with the floor and positioned at a comfortable height. As noted above, the armrests 3 may also be rotated into a third (e.g., neutral) position according to the configuration for the third mode for storage.

In some embodiments, the folding chair 100 may be constructed according to a modular design with interchangeable elements/component parts. For example, the modular supports 1*a* and 1*b* may be removable, identical to each other and made of fabric, leather, plastic, rubber, wood, metal or some other such materials. The supports 1*a* and 1*b* may either act as 'slings' that span between the sides of the first and second frames 2*a* and 2*b* in the case of the fabric and leather material options or may be implemented as more rigid elements that may also attach to the sides of the first and second frames 2*a* and 2*b*.

Figure 3:
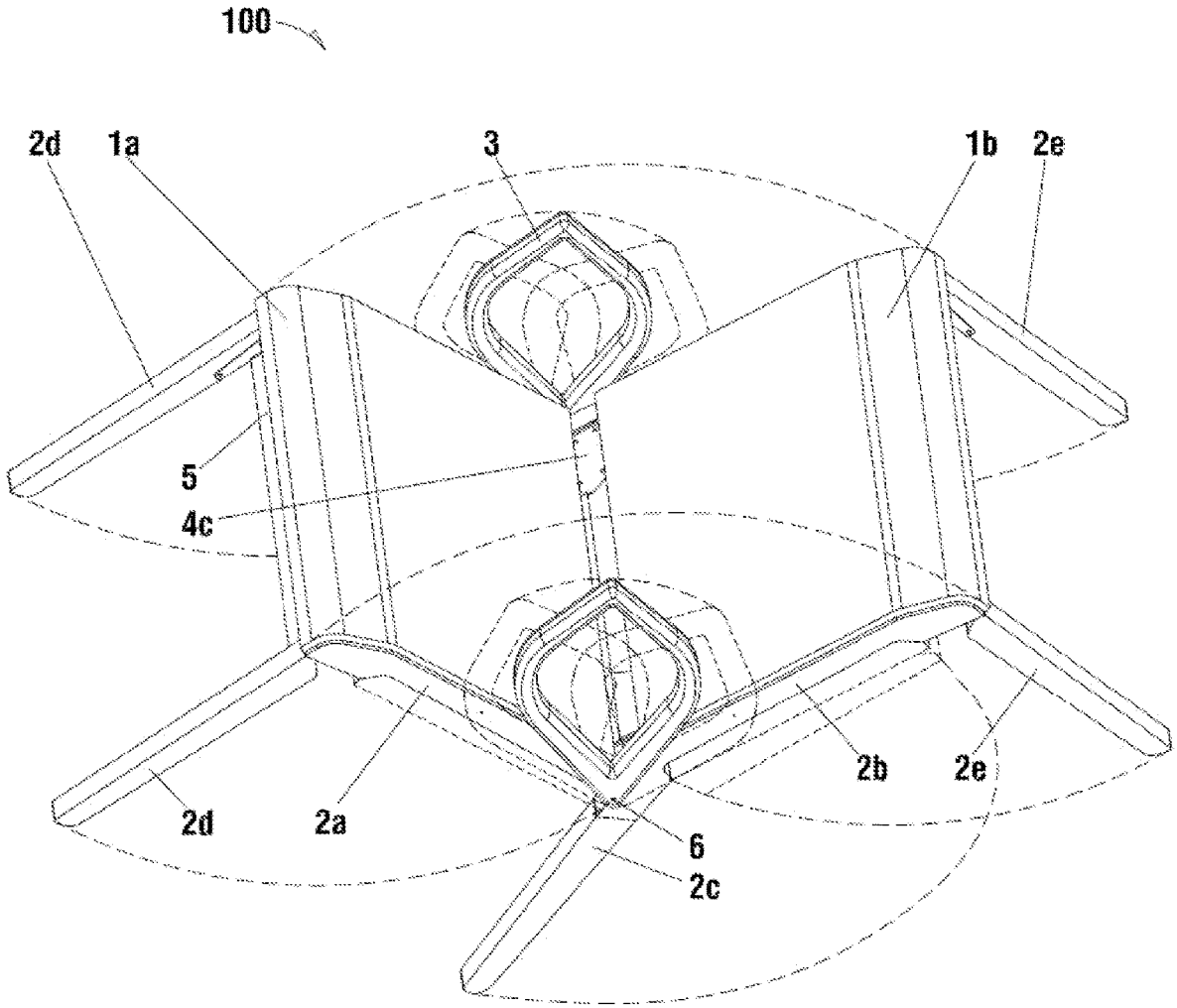
FIG. 3 shows an isometric view of the folding chair, consistent with some embodiments described herein, illustrating the range of rotation of component parts.

FIG. 3 shows an isometric view of the folding chair 100, consistent with some embodiments described herein, illustrating the range of rotation of component parts.

As shown in FIG. 3, the folding chair 100 may include the following component parts. The first and second supports 1*a* and 1*b* may be arranged in the first and second frames 2*a* and 2*b*, respectively. The armrests 3 may be rotatably connected (e.g., via respective hinges 6) to opposite sides of the joint assembly 4*c* that rotatably connects the first frame 2*a* to the second frame 2*b*. Each of the frames 2*a* and 2*b* and each of the pairs of legs 2*c*, 2*d* and 2*e* may include cross members 5 as described above with respect to FIG. 2. Furthermore, each of the 6 legs may be rotatably attached to the first and second frames 2*a* and 2*b* as follows. The first pair of legs 2*c* may be rotatably attached to the second frame 2*b*, the second pair of legs 2*d* may be rotatably attached to the first frame 2*a*, and the third pair of legs 2*e* may be rotatably attached to the second frame 2*b*. As noted above, these rotatable connections may be implemented via additional joint assemblies similar to 4*a*-4*c*.

Figure 4:
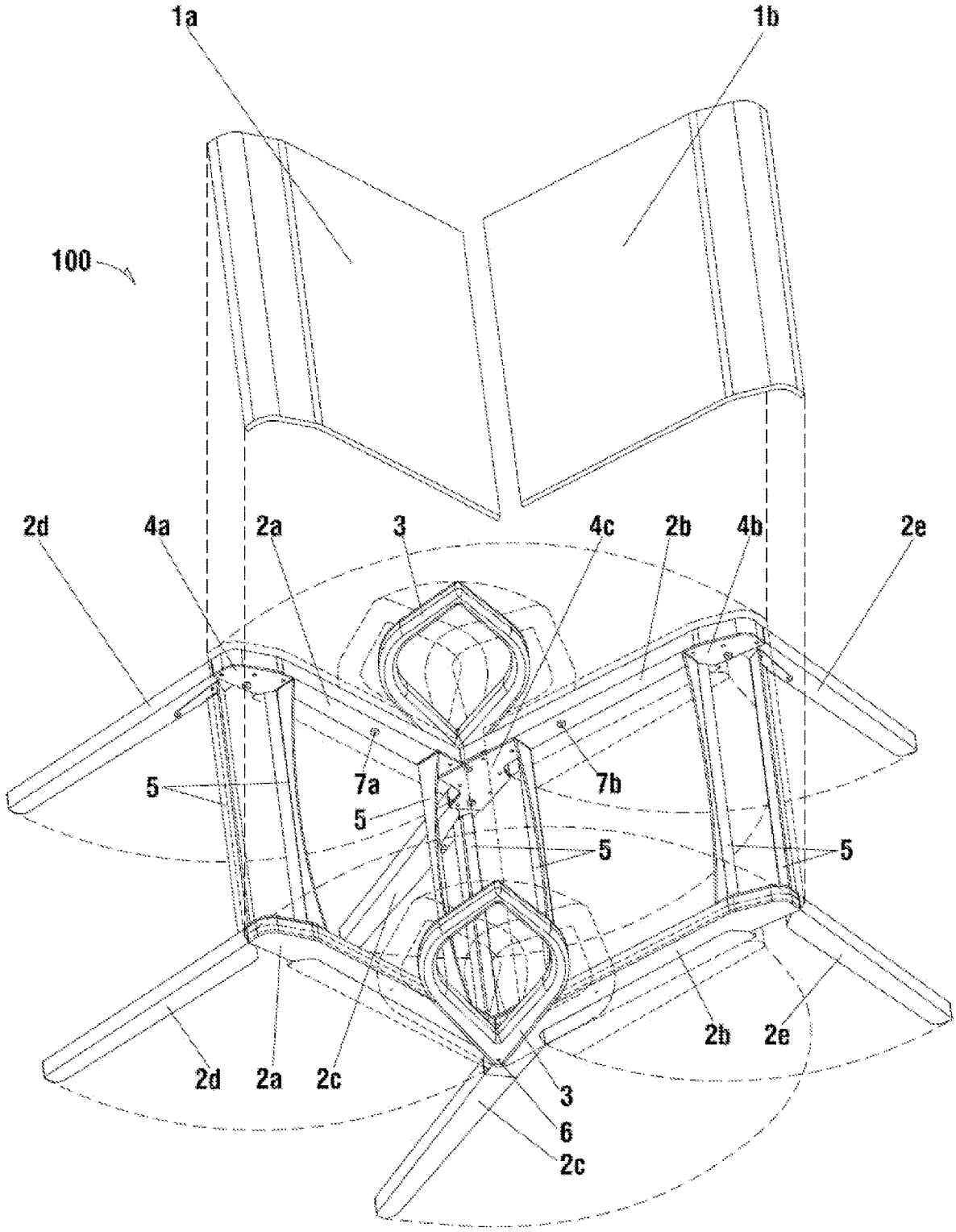
FIG. 4 shows another isometric view (with seat/backrests exploded) of the folding chair, consistent with some embodiments described herein, illustrating the range of rotation of component parts.

FIG. 4 shows another isometric view (with seat/backrests exploded) of the folding chair 100, consistent with some embodiments described herein, illustrating the range of rotation of component parts.

As shown in FIG. 4, the folding chair 100 may include the following component parts. The first and second supports 1*a* and 1*b* may be arranged in the first and second frames 2*a* and 2*b*, respectively. The armrests 3 may be rotatably connected (e.g., via respective hinges 6) to opposite sides of the joint assembly 4*c* that rotatably connects the first frame 2*a* to the second frame 2*b*. Each of the armrests 3 may be locked into position with respect to the first frame 2*a* via a pair of locking mechanisms 7*a* (e.g., each on an opposite side of frame 2*a*) or locked into position with respect to the second frame 2*b* via a pair of locking mechanisms 7*b* (e.g., each on an opposite side of frame 2*b*). Each of the frames 2*a* and 2*b* and each of the pairs of legs 2*c*, 2*d* and 2*e* may include cross members 5 as described above with respect to FIG. 2. Furthermore, each of the 6 legs may be rotatably attached to the first and second frames 2*a* and 2*b* (e.g., via joint assemblies 4*c* and/or other such rotatable connections) as follows. The first pair of legs 2*c* may be rotatably attached to the joint assembly 4*c* that connects the first frame 2*a* to the second frame 2*b*, the second pair of legs 2*d* may be rotatably attached to the first frame 2*a*, and the third pair of legs 2*e* may be rotatably attached to the second frame 2*b*.

Figure 5:
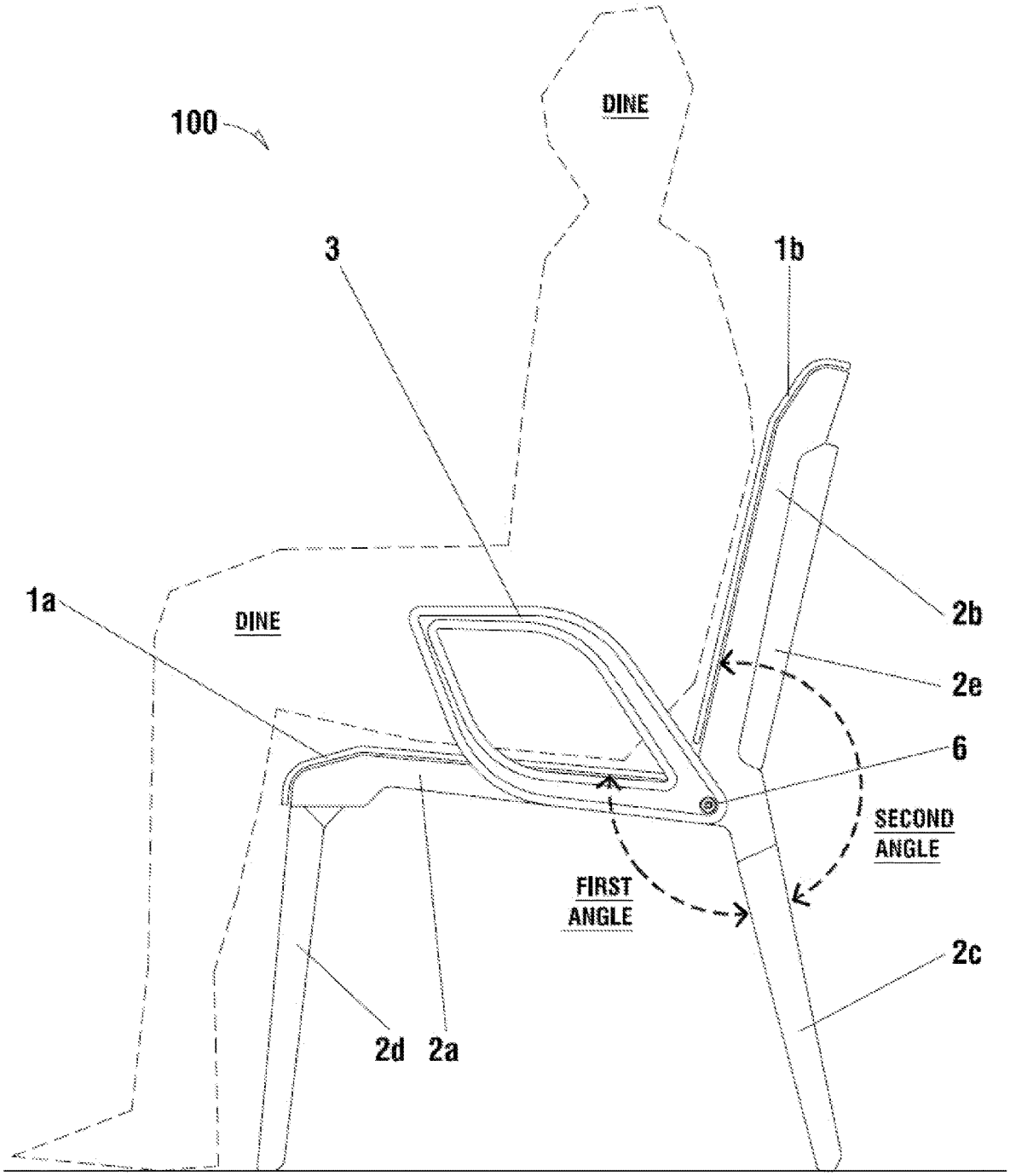
FIG. 5 shows a side view of the folding chair, consistent with some embodiments described herein, configured in a first "dining" mode.

FIG. 5 shows a side view of the folding chair 100, consistent with some embodiments described herein, configured in a first "dining" mode.

The folding chair 100 may be configured in a first mode for dining as follows. The first support 1*a* may be configured to provide a seat of a dining chair and the second support 1*b* may be configured to provide a backrest of the dining chair. A surface of the second support 1*b* may be configured to vertically incline with respect to a surface of the first support 1*a* and the second pair of legs 2*d*, being on an opposite side of the second support 1*b*, may be configured to be vertically inclined with respect to the surface of the first support 1*a*. The first pair of legs 2*c* may be configured to be at a first angle with respect to the surface of the first support 1*a* and to be at a second angle with respect to the surface of the second support 1*b*, wherein the second angle is larger than the first angle. Furthermore, the third pair of legs 2*e* may be configured to be folded into recess areas in the second frame 2*b* and the pair of armrests 3 may be configured (e.g., using hinges 6) to be in a dining position, wherein the pair of armrests 3 each includes a first member to provide an arm support for a sitting user of folding chair 100, and each armrest 3 also includes a second member being locked to a corresponding side of the first frame 2*a* (e.g., via locking mechanisms 7*a* not shown in FIG. 5).

Figure 6:
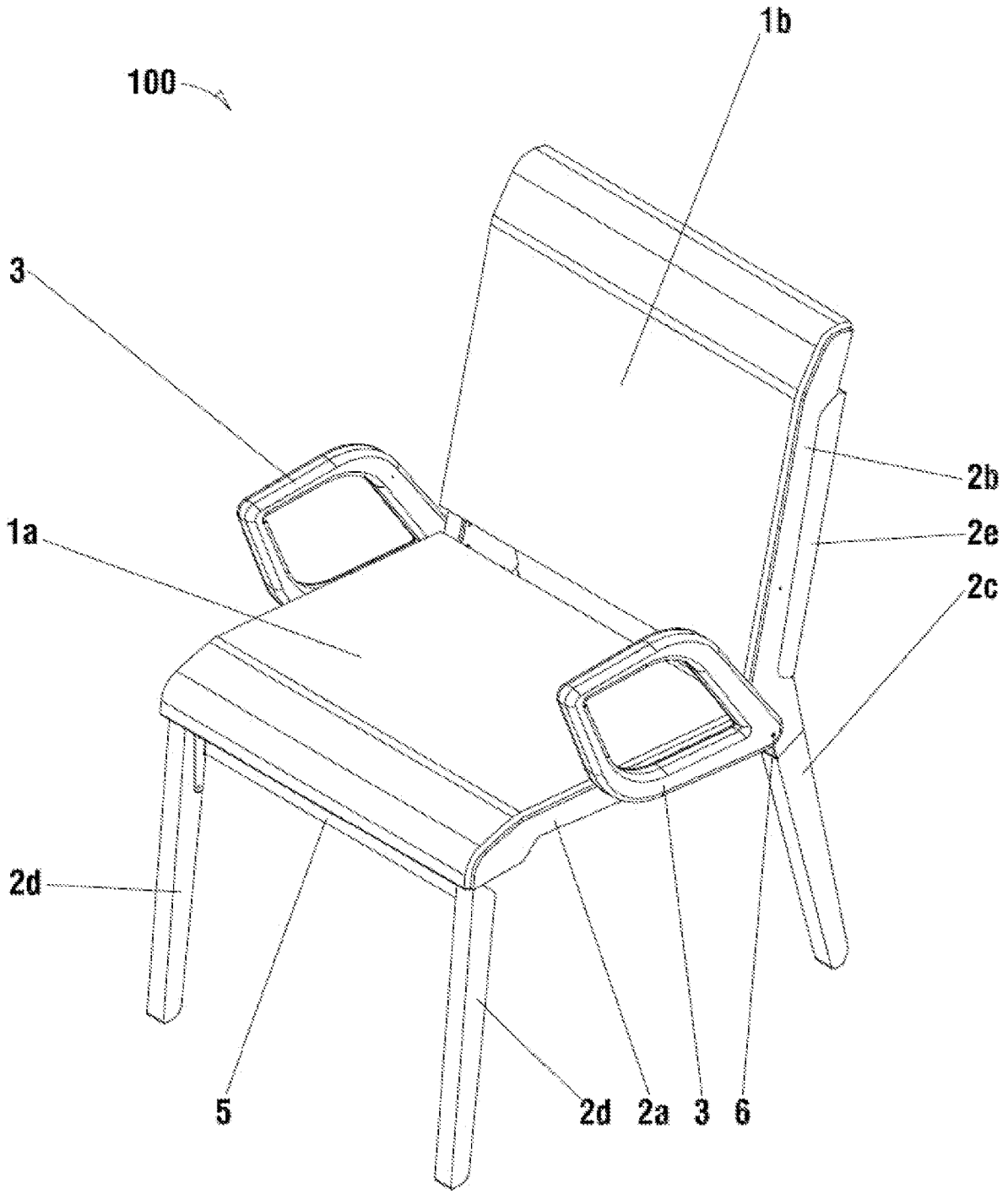
FIG. 6 shows an isometric view of the folding chair, consistent with some embodiments described herein, configured in the first "dining" mode.

FIG. 6 shows an isometric view of the folding chair 100, consistent with some embodiments described herein, configured in the first "dining" mode.

As shown in FIG. 6, the folding chair 100 may deploy the following component parts according to the dining configuration described above with respect to FIG. 5. The first and second supports 1*a* and 1*b* may be arranged in the first and second frames 2*a* and 2*b*, respectively. The armrests 3 may be rotatably connected (e.g., via respective hinges 6) to opposite sides of the joint assembly 4*c* (not shown in FIG. 6) that rotatably connects the first frame 2*a* to the second frame 2*b*. As noted above, each of the pairs of legs 2*c*, 2*d* and 2*e* may include cross members 5 to provide lateral support or to act as compression elements. For example, the cross members 5 are shown connecting the pair of legs 2*d* in FIG. 6. Furthermore, each of the 6 legs (e.g., pairs 2*c*, 2*d* and 2*e*)

may be deployed with respect to the first and second frames 2*a* and 2*b* as follows. The first pair of legs 2*c* may be deployed in an extended position, the second pair of legs 2*d* may also be deployed in an extended position, and the third pair of legs 2*e* may be deployed in a folded position within a recess of the second frame 2*b* or deployed in a folded position adjacent to the second frame 2*b*.

Figure 7:
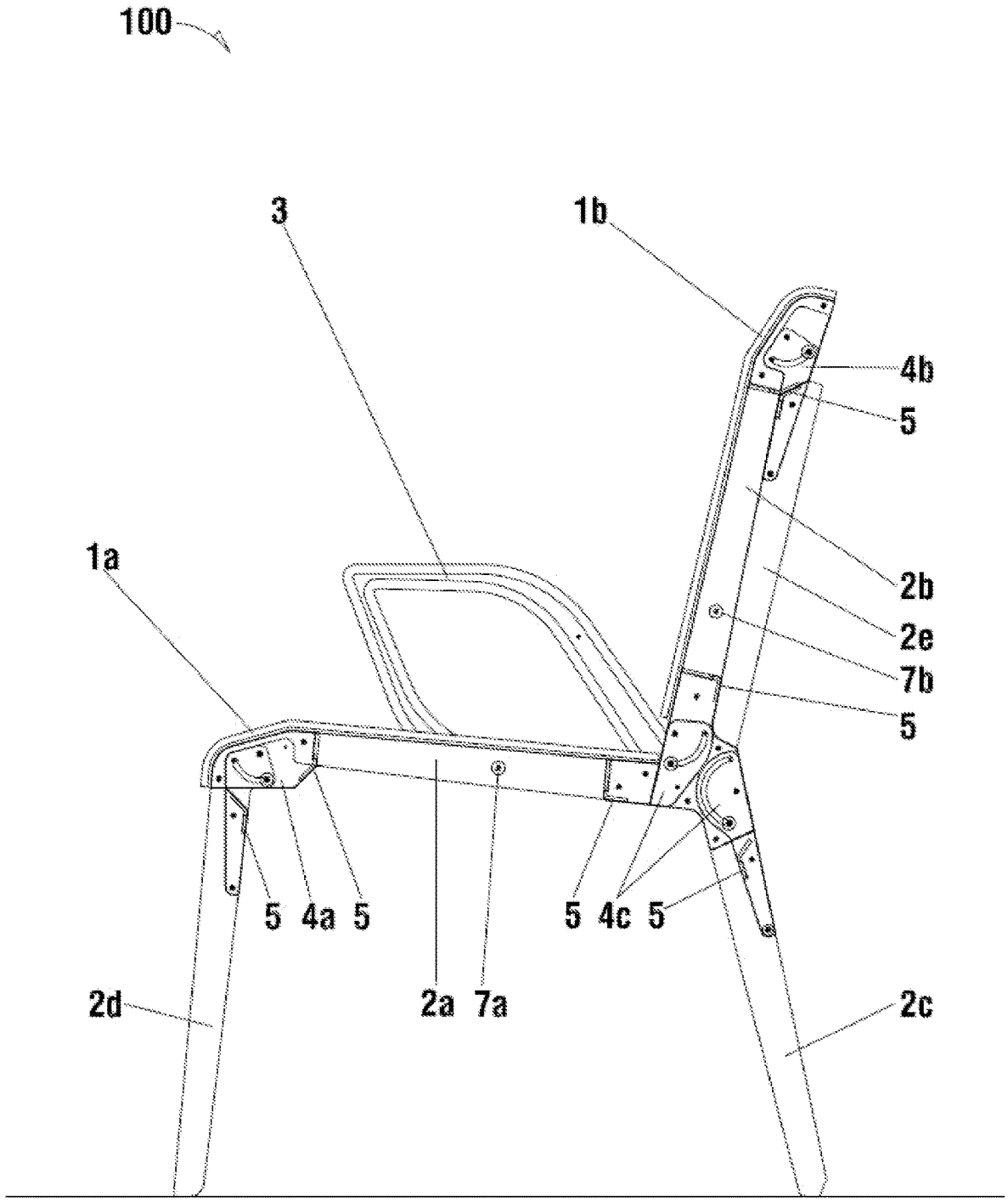
FIG. 7 shows a section view of the folding chair, consistent with some embodiments described herein, configured in the first "dining" mode.

FIG. 7 shows a section view of the folding chair 100, consistent with some embodiments described herein, configured in the first "dining" mode.

As shown in FIG. 7, the folding chair 100 may deploy the following component parts according to the dining configuration described above with respect to FIG. 5. The first and second supports 1*a* and 1*b* may be arranged in the first and second frames 2*a* and 2*b*, respectively. The armrests 3 may be rotatably connected (e.g., via respective hinges 6) to opposite sides of the joint assembly 4*c* that rotatably connects the first frame 2*a* to the second frame 2*b*. Each of the frames 2*a* and 2*b* and the pairs of legs 2*c*, 2*d* and 2*e* may include cross members 5 to provide lateral support or to act as compression elements. In some embodiments the cross members 5 may be integrated into the joint assemblies 4*c* or other rotatable connections of folding chair 100. Furthermore, each of the 6 legs (e.g., pairs 2*c*, 2*d* and 2*e*) may be deployed (e.g., via joint assemblies 4*c* or other rotatable connections) in the first dining mode with respect to the first and second frames 2*a* and 2*b* as described above with respect to FIG. 5 and FIG. 6.

Figure 8:
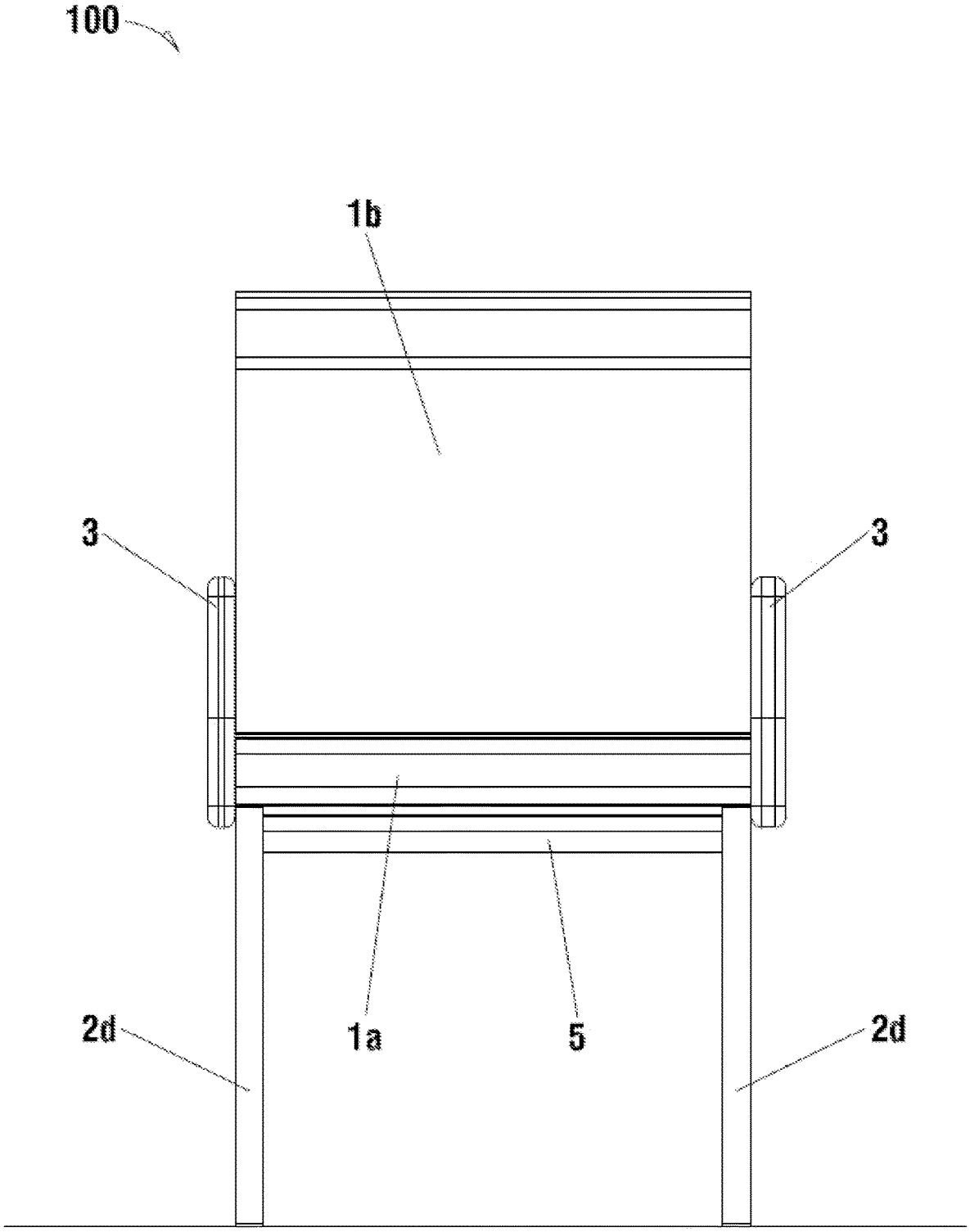
FIG. 8 shows a front view of the folding chair, consistent with some embodiments described herein, configured in the first "dining" mode.

FIG. 8 shows a front view of the folding chair 100, consistent with some embodiments described herein, configured in the first "dining" mode.

As shown in FIG. 8, the folding chair 100 may deploy the following component parts according to the dining configuration described above with respect to FIG. 5. The first and second supports 1*a* and 1*b* may be arranged in the first and second frames 2*a* and 2*b* (both not shown in FIG. 8), respectively. The armrests 3 may be rotatably connected (e.g., via respective hinges 6 not shown in FIG. 8) to opposite sides of the joint assembly 4*c* (also not shown in FIG. 8) that rotatably connects the first frame 2*a* to the second frame 2*b*. As noted above, each of the pairs of legs 2*c*, 2*d* and 2*e* may include cross members 5 to provide lateral support or to act as compression elements. For example, the cross member 5 is shown connecting the pair of legs 2*d* in FIG. 8. As noted above, each of the 6 legs (e.g., pairs 2*c*, 2*d* and 2*e*) may be deployed in the first dining mode with respect to the first and second frames 2*a* and 2*b*. However, the first pair of legs 2*c* and the third pair of legs 2*e* are also not shown in FIG. 8. The second pair of legs 2*d* are shown deployed in the extended position as described above with respect to FIGS. 5 and 6.

Figure 9:
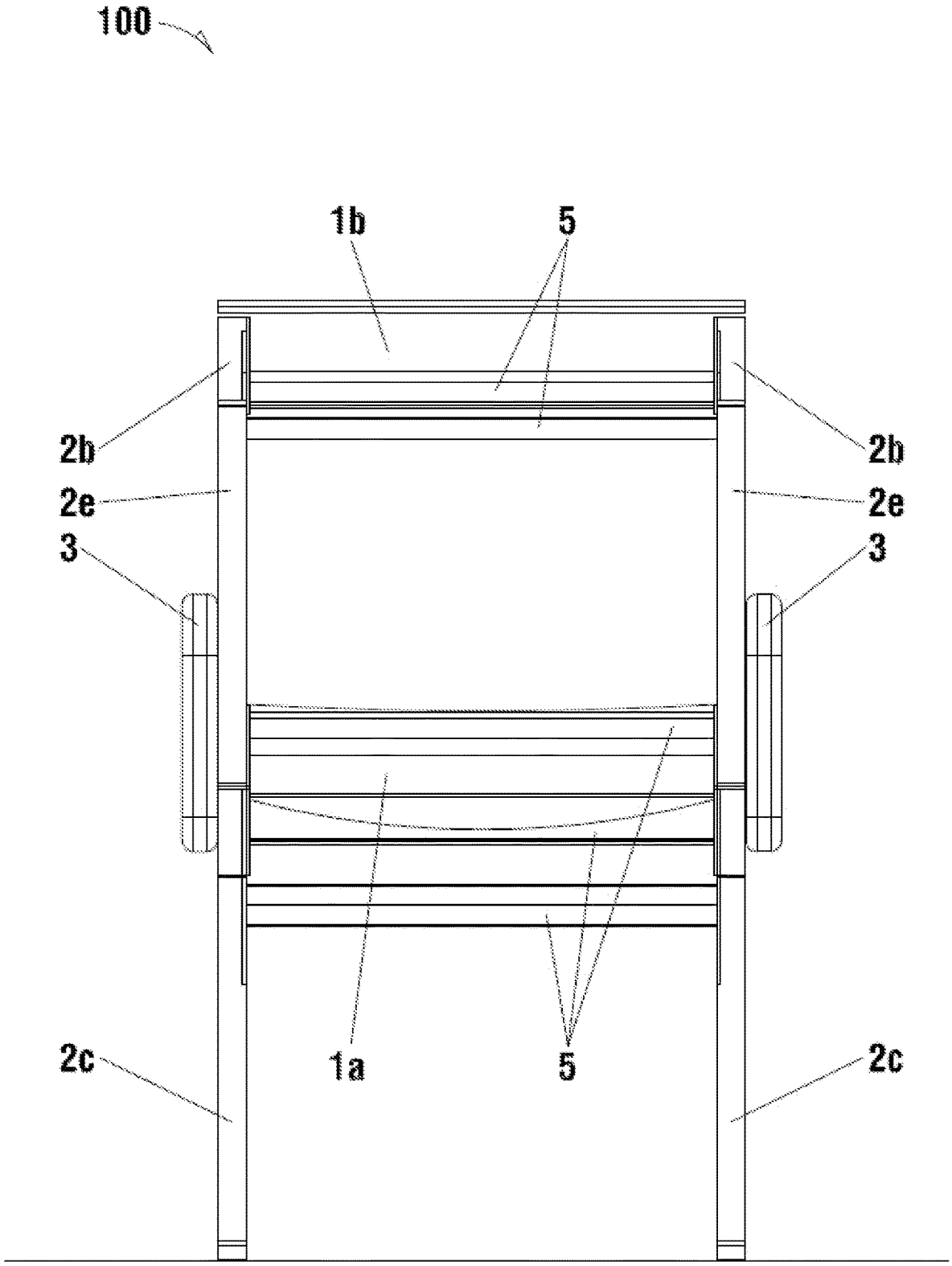
FIG. 9 shows a back view of the folding chair, consistent with some embodiments described herein, configured in the first "dining" mode.

FIG. 9 shows a back view of the folding chair 100, consistent with some embodiments described herein, configured in the first "dining" mode.

As shown in FIG. 9, the folding chair 100 may deploy the following component parts according to the dining configuration described above with respect to FIG. 5. The first and second supports 1*a* and 1*b* may be arranged in the first and second frames 2*a* and 2*b*, respectively. The armrests 3 may be rotatably connected (e.g., via respective hinges 6 not shown in FIG. 9) to opposite sides of the joint assembly 4*c* (also not shown in FIG. 9) that rotatably connects the first frame 2*a* to the second frame 2*b*. Each of the frames 2*a* and 2*b* and the pairs of legs 2*c*, 2*d* and 2*e* may include cross members 5 to provide lateral support or to act as compression elements. For example, 3 cross members 5 are shown at the frames 2*a* and 2*b* and 2 cross member 5 are shown connecting the pair of legs 2*c* and 2*e* respectively in FIG. 9. As noted above, the 6 legs may be deployed in the first dining mode with respect to the first and second frames 2*a* and 2*b*. However, the second pair of legs 2*d* are also not shown in FIG. 9. The first pair of legs 2*c* are shown deployed in an extended position and the third pair of legs 2*e* are shown deployed in a folded position within a recess of the second frame 2*b*, as described above with respect to FIG. 5 and FIG. 6.

Figure 10:
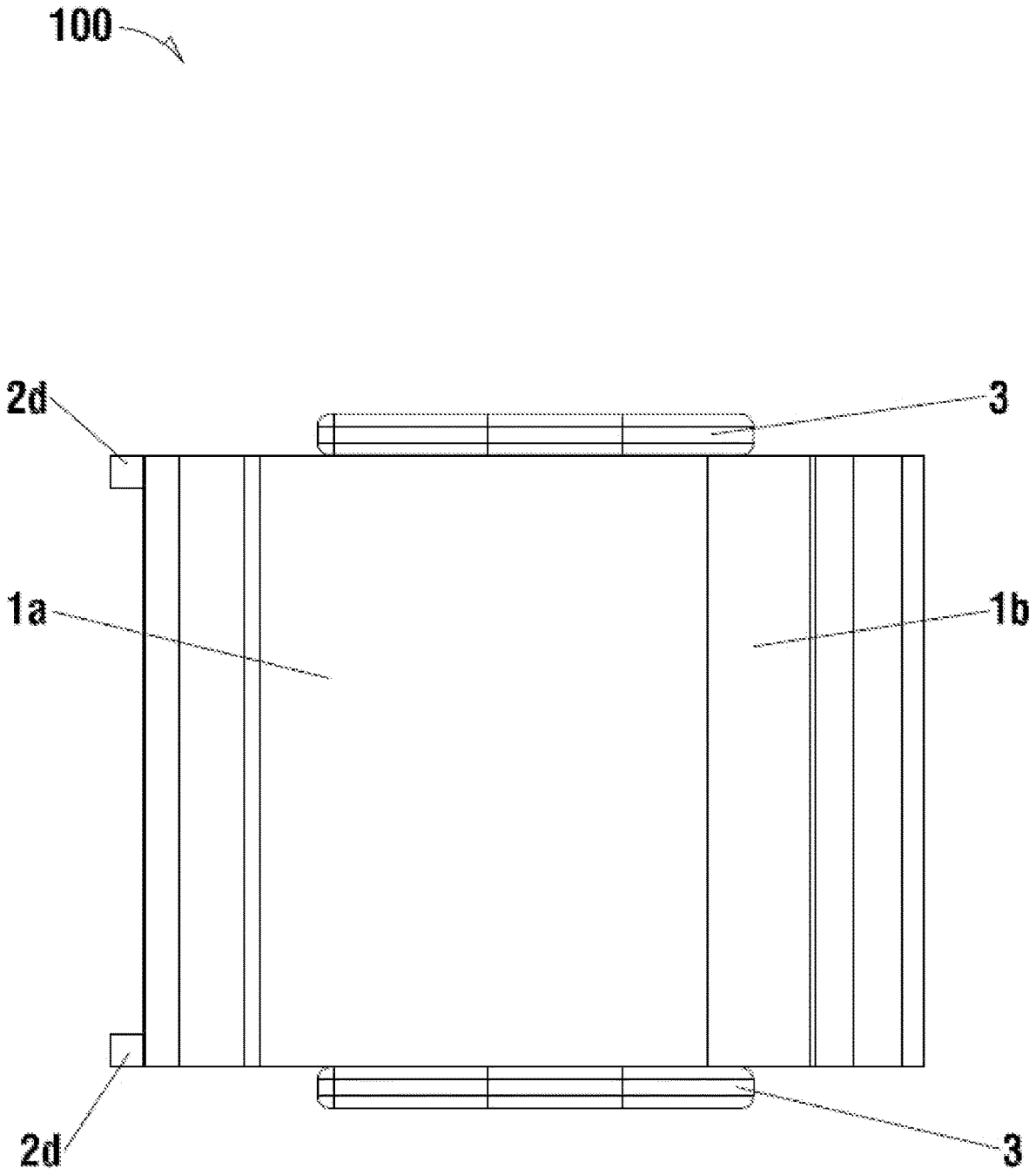
FIG. 10 shows a top view of the folding chair, consistent with some embodiments described herein, configured in the first "dining" mode.

FIG. 10 shows a top view of the folding chair 100, consistent with some embodiments described herein, configured in the first "dining" mode.

As shown in FIG. 10, the folding chair 100 may deploy the following component parts according to the dining configuration described above with respect to FIG. 5. The first and second supports 1*a* and 1*b* may be arranged in the first and second frames 2*a* and 2*b* (both not shown in FIG. 10), respectively. The armrests 3 may be rotatably connected (e.g., via respective hinges 6 not shown in FIG. 10) to opposite sides of the joint assembly 4*c* (also not shown in FIG. 10) that rotatably connects the first frame 2*a* to the second frame 2*b*. As noted above, the 6 legs may be deployed in the first dining mode with respect to the first and second frames 2*a* and 2*b*. However, the first pair of legs 2*c* and the third pair of legs 2*e* are also not shown in FIG. 10. The second pair of legs 2*d* are shown deployed in the extended position as described above with respect to FIG. 5 and FIG. 6.

Figure 11:
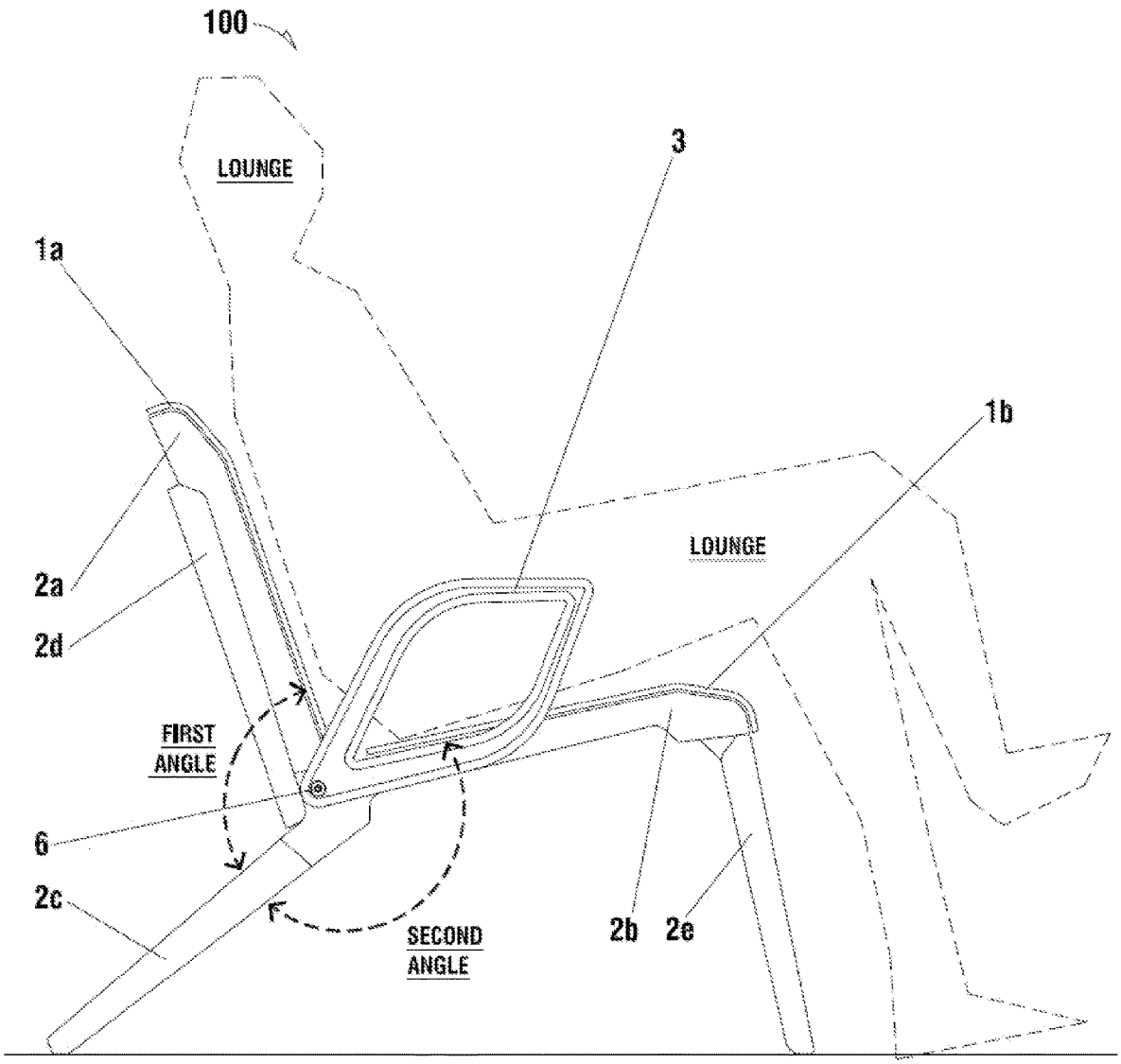
FIG. 11 shows a side view of the folding chair, consistent with some embodiments described herein, configured in a second "lounging" mode.

FIG. 11 shows a side view of the folding chair 100, consistent with some embodiments described herein, configured in a second "lounging" mode.

The folding chair 100 may be configured in a second mode for lounging as follows. The first support 1*a* may provide a backrest of the lounging chair and the second support 1*b* may provide a seat of the lounging chair. The surface of the first support 1*a* may being configured to vertically incline with respect to the surface of the second support 1*b*. The third pair of legs 2*e* may be configured to be vertically inclined with respect to the surface of the second support 2*b* with the third pair of legs 2*e* being on an opposite side of the first support 1*a*. The first pair of legs 2*c* may be configured to be at a first angle with respect to the surface of the first support 1*a* and to be at a second angle with respect to the surface of the second support 1*b*, wherein the second angle is larger than the first angle. The second pair of legs 2*d* may be configured to be folded in recess areas in the first frame 2*a*. The pair of armrests 3 may be configured to be in a lounging position, wherein the second members of the pair of armrests 3 provide an arm support (e.g., for a sitting user of folding chair 100) and the first members of the pair of armrest 3 are locked to a corresponding side of the second frame 2*b* (e.g., via locking mechanisms 7*b* not shown in FIG. 11).

Figure 12:
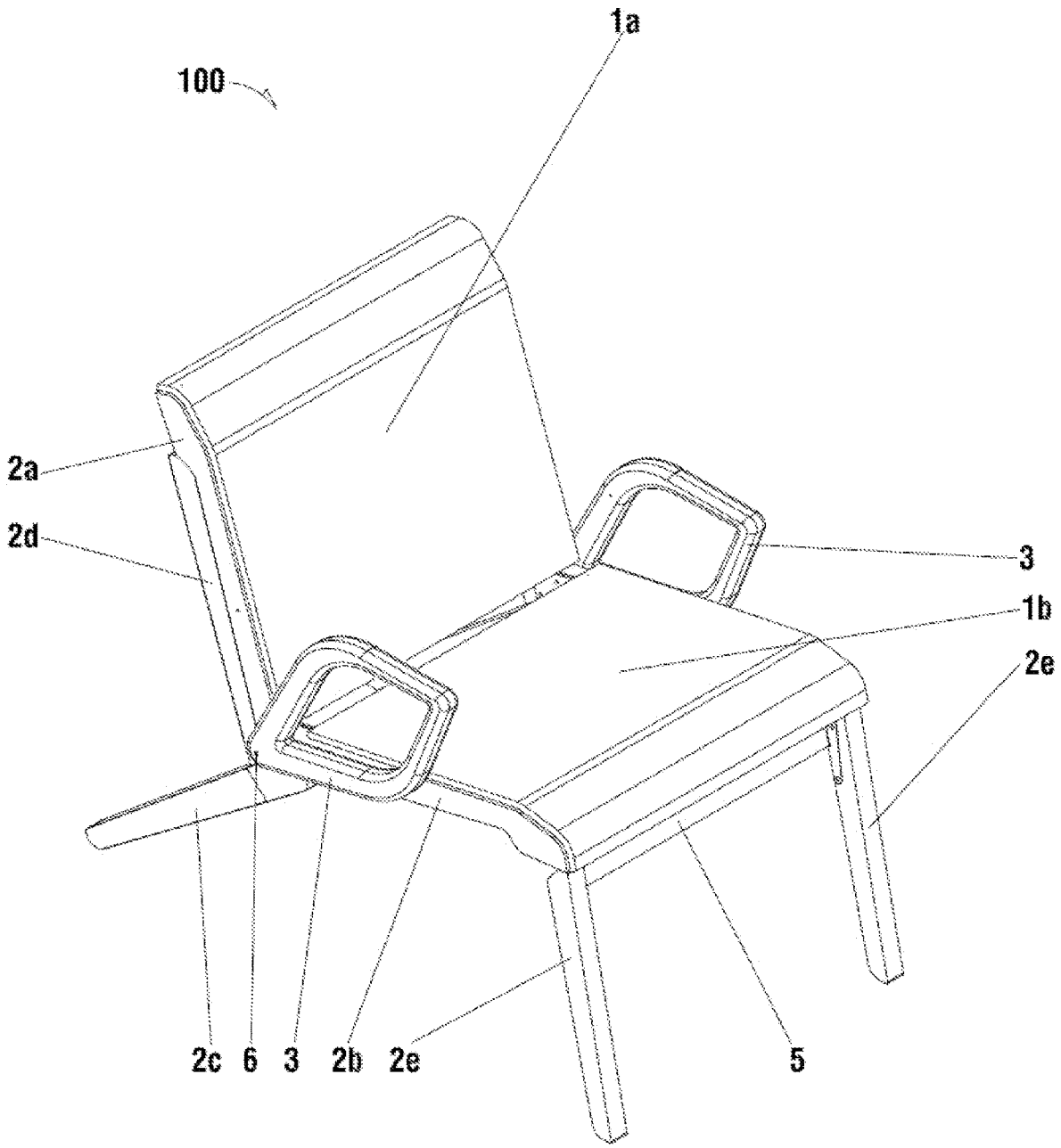
FIG. 12 shows an isometric view of the folding chair, consistent with some embodiments described herein, configured in the second "lounging" mode.

FIG. 12 shows an isometric view of the folding chair 100, consistent with some embodiments described herein, configured in the second "lounging" mode.

As shown in FIG. 12, the folding chair 100 may deploy the following component parts according to the lounging configuration described above with respect to FIG. 11. The first and second supports 1*a* and 1*b* may be arranged in the first and second frames 2*a* and 2*b*, respectively. The armrests 3 may be rotatably connected (e.g., via respective hinges 6) to opposite sides of the joint assembly 4*c* (not shown in FIG. 12) that rotatably connects the first frame 2*a* to the second frame 2*b*. As noted above, each of the pairs of legs 2*c*, 2*d* and 2*e* may include cross members 5 to provide lateral support or to act as compression elements. For example, the cross members 5 are shown connecting the pair of legs 2*e* in FIG. 12. Furthermore, each of the 6 legs (e.g., pairs 2*c*, 2*d* and 2*e*) may be deployed with respect to the first and second frames 2*a* and 2*b* as follows. The first pair of legs 2*c* may be deployed in an extended position, the third pair of legs 2*e* may also be deployed in an extended position, and the second pair of legs 2*d* may be deployed in a folded position within a recess of the second frame 2*b*.

Figure 13:
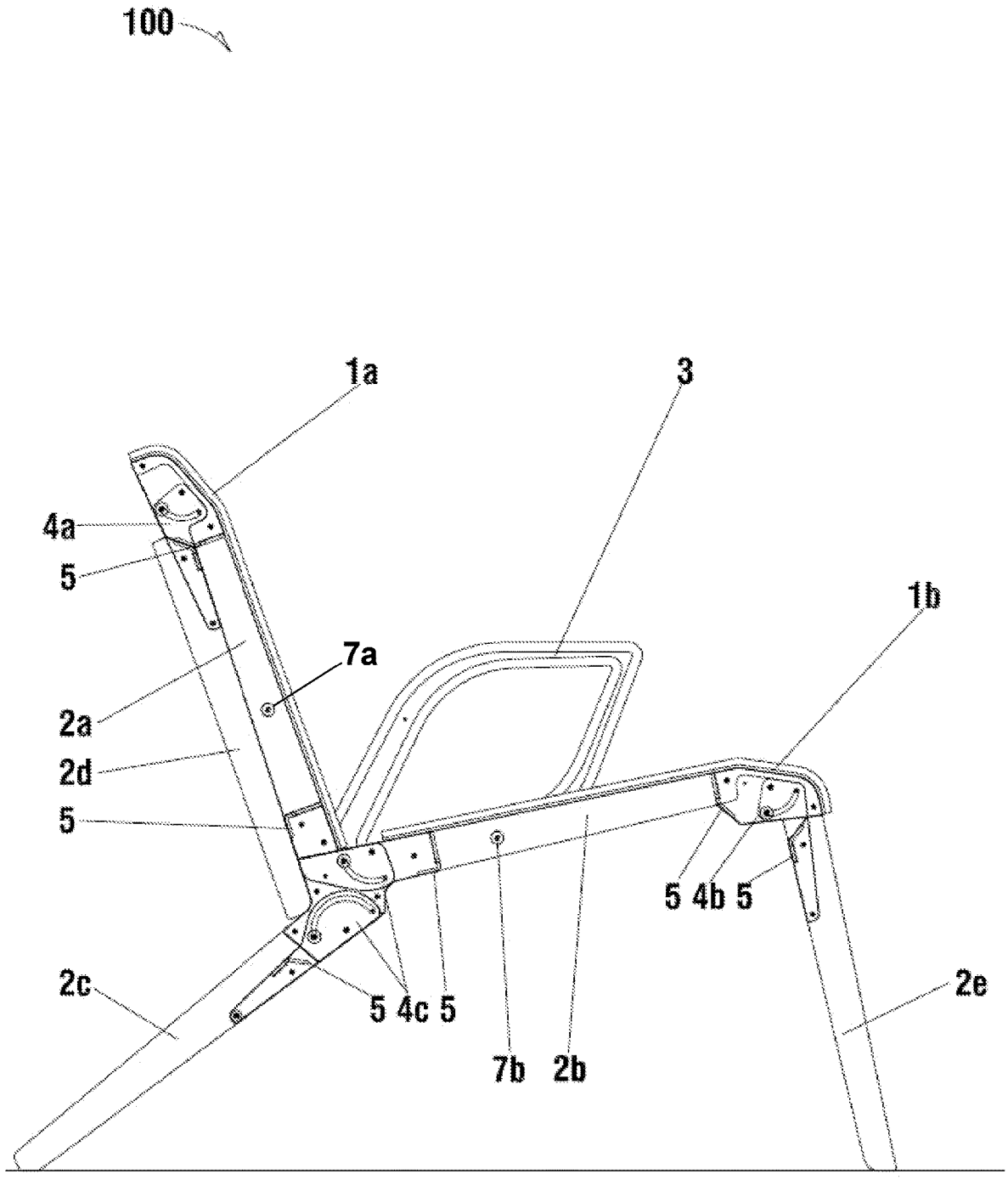
FIG. 13 shows a section view of the folding chair, consistent with some embodiments described herein, configured in the second "lounging" mode.

FIG. 13 shows a section view of the folding chair 100, consistent with some embodiments described herein, configured in the second "lounging" mode.

As shown in FIG. 13, the folding chair 100 may deploy the following component parts according to the lounging configuration described above with respect to FIG. 11. The first and second supports 1*a* and 1*b* may be arranged in the first and second frames 2*a* and 2*b*, respectively. The armrests 3 may be rotatably connected (e.g., via respective hinges 6) to opposite sides of the joint assembly 4*c* that rotatably connects the first frame 2*a* to the second frame 2*b*. Each of the frames 2*a* and 2*b* and the pairs of legs 2*c*, 2*d* and 2*e* may include cross members 5 to provide lateral support or to act as compression elements. In some embodiments the cross members 5 may be integrated into the joint assemblies 4*a*, 4*b* or other rotatable connections of folding chair 100. Furthermore, each of the 6 legs may be deployed (e.g., via joint assemblies 4*a*-4*c* or other rotatable connections) in the second lounging mode with respect to the first and second frames 2*a* and 2*b* as described above with respect to FIG. 11 and FIG. 12.

Figure 14:
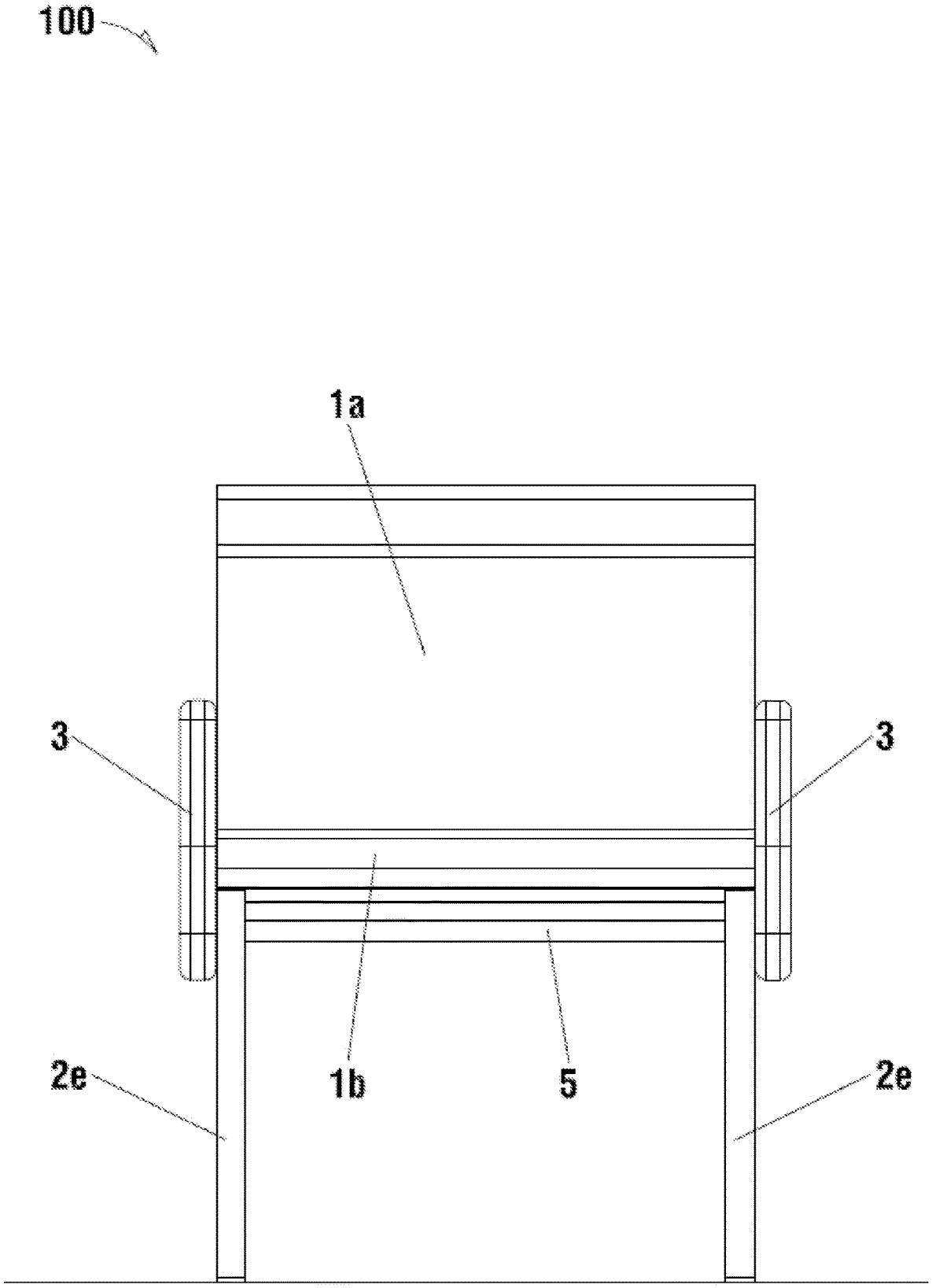
FIG. 14 shows a front view of the folding chair, consistent with some embodiments described herein, configured in the second "lounging" mode.

FIG. 14 shows a front view of the folding chair 100, consistent with some embodiments described herein, configured in the second "lounging" mode.

As shown in FIG. 14, the folding chair 100 may deploy the following component parts according to the lounging configuration described above with respect to FIG. 11. The first and second supports 1*a* and 1*b* may be arranged in the first and second frames 2*a* and 2*b* (both not shown in FIG. 14), respectively. The armrests 3 may be rotatably connected (e.g., via respective hinges 6 not shown in FIG. 14) to opposite sides of the joint assembly 4*c* (also not shown in FIG. 14) that rotatably connects the first frame 2*a* to the second frame 2*b*. As noted above, each of the pairs of legs 2*c*, 2*d* and 2*e* may include cross members 5 to provide lateral support or to act as compression elements. For example, a cross member 5 is shown connecting the pair of legs 2*e* in FIG. 14. As noted above, each of the 6 legs (e.g., pairs 2*c*, 2*d* and 2*e*) may be deployed in the second lounging mode with respect to the first and second frames 2*a* and 2*b*. However, the first pair of legs 2*c* and the second pair of legs 2*d* are also not shown in FIG. 14. The third pair of legs 2*e* are shown deployed in the extended position as described above with respect to FIG. 11 and FIG. 12.

Figure 15:
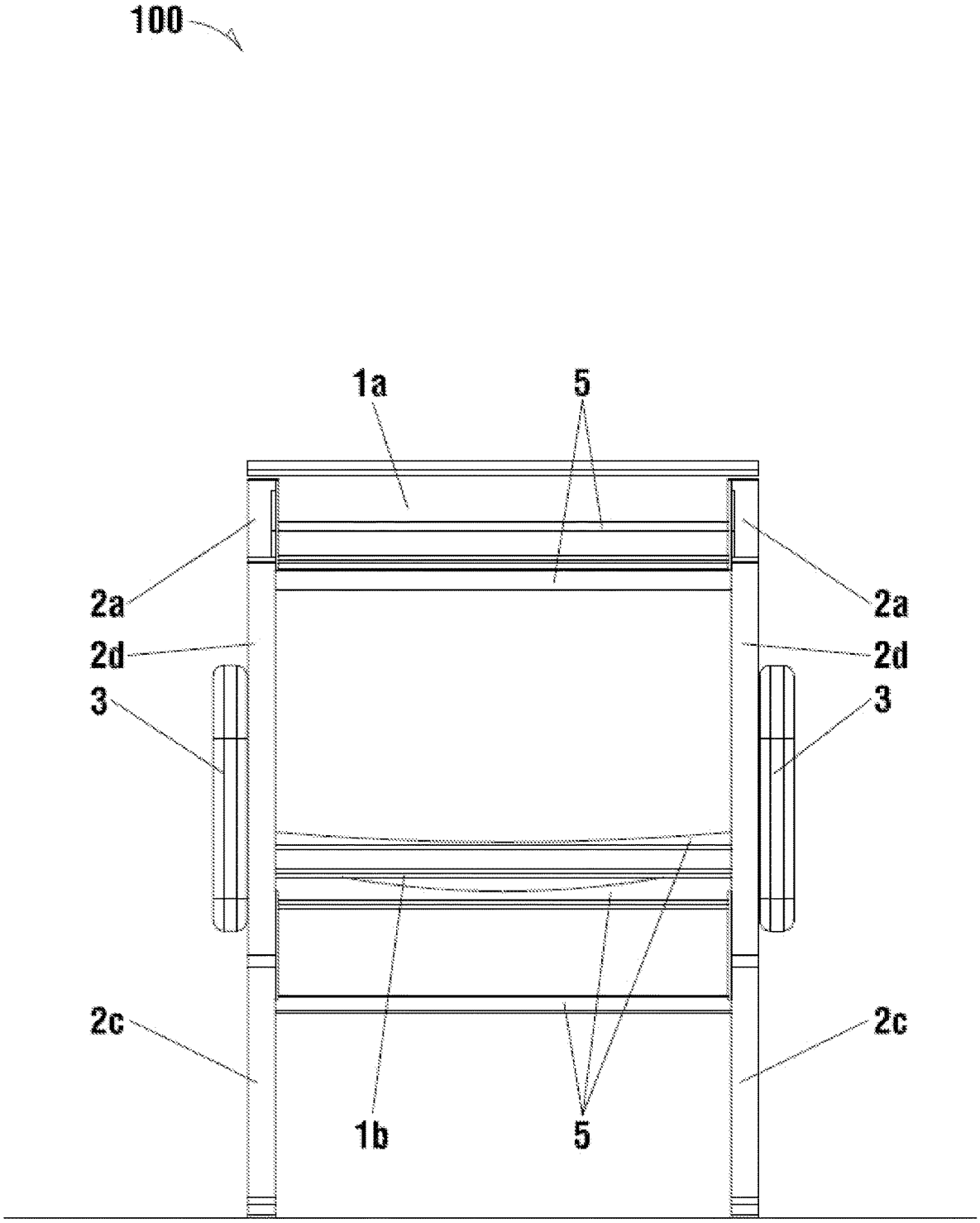
FIG. 15 shows a back view of the folding chair, consistent with some embodiments described herein, configured in the second "lounging" mode.

FIG. 15 shows a back view of the folding chair 100, consistent with some embodiments described herein, configured in the second "lounging" mode.

As shown in FIG. 15, the folding chair 100 may deploy the following component parts according to the lounging configuration described above with respect to FIG. 11. The first and second supports 1*a* and 1*b* may be arranged in the first and second frames 2*a* and 2*b* (not shown in FIG. 15), respectively. The armrests 3 may be rotatably connected (e.g., via respective hinges 6 not shown in FIG. 15) to opposite sides of the joint assembly 4*c* (also not shown in FIG. 15) that rotatably connects the first frame 2*a* to the second frame 2*b*. Each of the frames 2*a* and 2*b* and the pairs of legs 2*c*, 2*d* and 2*e* may include cross members 5 to provide lateral support or to act as compression elements. For example, 3 cross members 5 are shown at the frames 2*a* and 2*b* and 2 cross member 5 are shown connecting the pair of legs 2*c* and 2*d* respectively in FIG. 15. As noted above, the 6 legs may be deployed in the second lounging mode with respect to the first and second frames 2*a* and 2*b*. However, the third pair of legs 2*e* are also not shown in FIG. 15. The first pair of legs 2*c* are shown deployed in an extended position and the second pair of legs 2*d* are shown deployed in a folded position within a recess of the first frame 2*a*, as described above with respect to FIG. 11 and FIG. 12.

Figure 16:
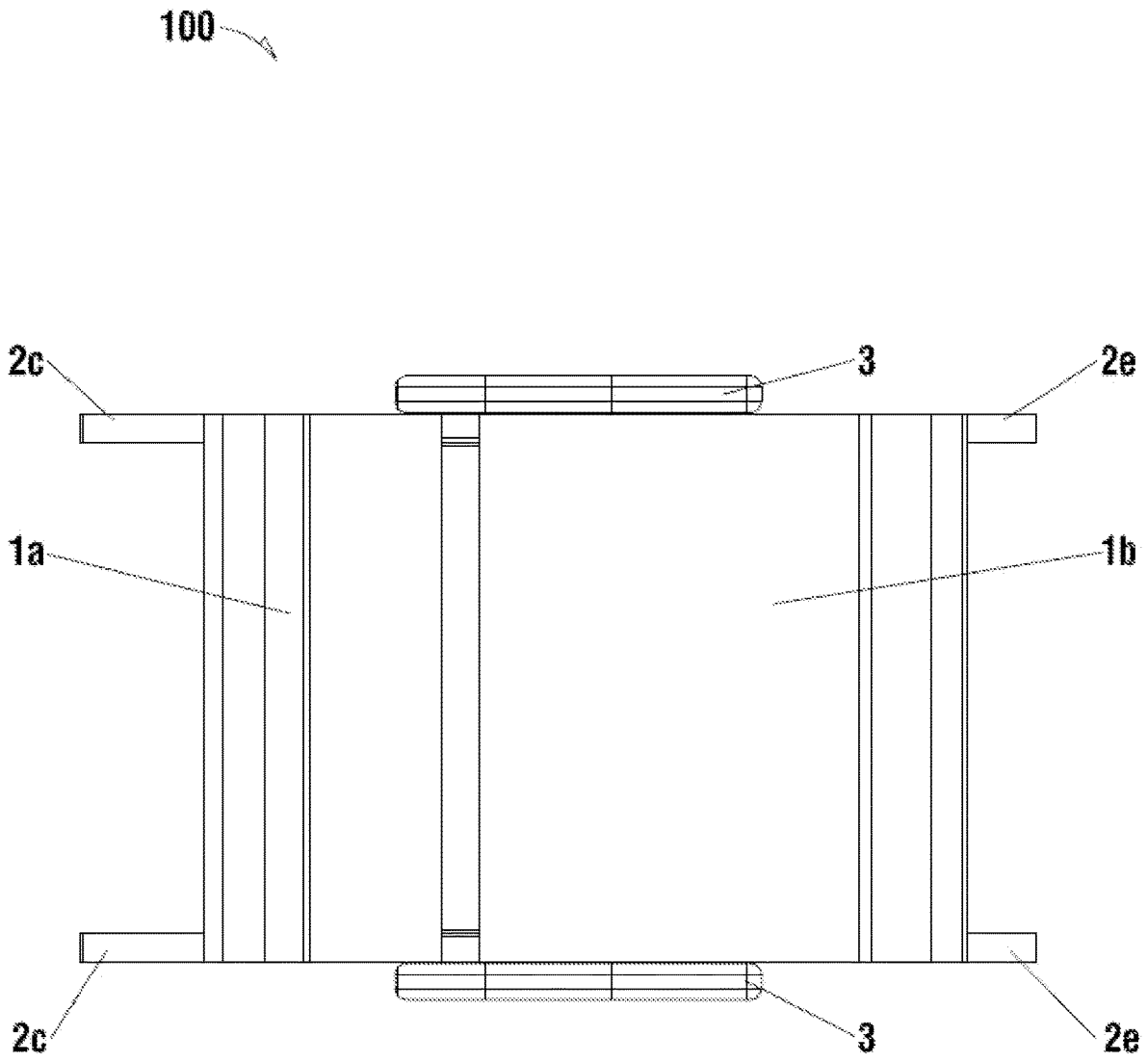
FIG. 16 shows a top view of the folding chair, consistent with some embodiments described herein, configured in the second "lounging" mode.

FIG. 16 shows a top view of the folding chair 100, consistent with some embodiments described herein, configured in the second "lounging" mode.

As shown in FIG. 16, the folding chair 100 may deploy the following component parts according to the lounging configuration described above with respect to FIG. 11. The first and second supports 1*a* and 1*b* may be arranged in the first and second frames 2*a* and 2*b* (both not shown in FIG. 16), respectively. The armrests 3 may be rotatably connected (e.g., via respective hinges 6 not shown in FIG. 16) to opposite sides of the joint assembly 4*c* (also not shown in FIG. 16) that rotatably connects the first frame 2*a* to the second frame 2*b*. As noted above, the 6 legs may be deployed in the second lounging mode with respect to the first and second frames 2*a* and 2*b*. However, the second pair of legs 2*d* are also not shown in FIG. 16. The first pair of legs 2*c* and the third pair of legs 2*e* are both shown deployed in the extended position as described above with respect to FIG. 11 and FIG. 12.

Figure 17:
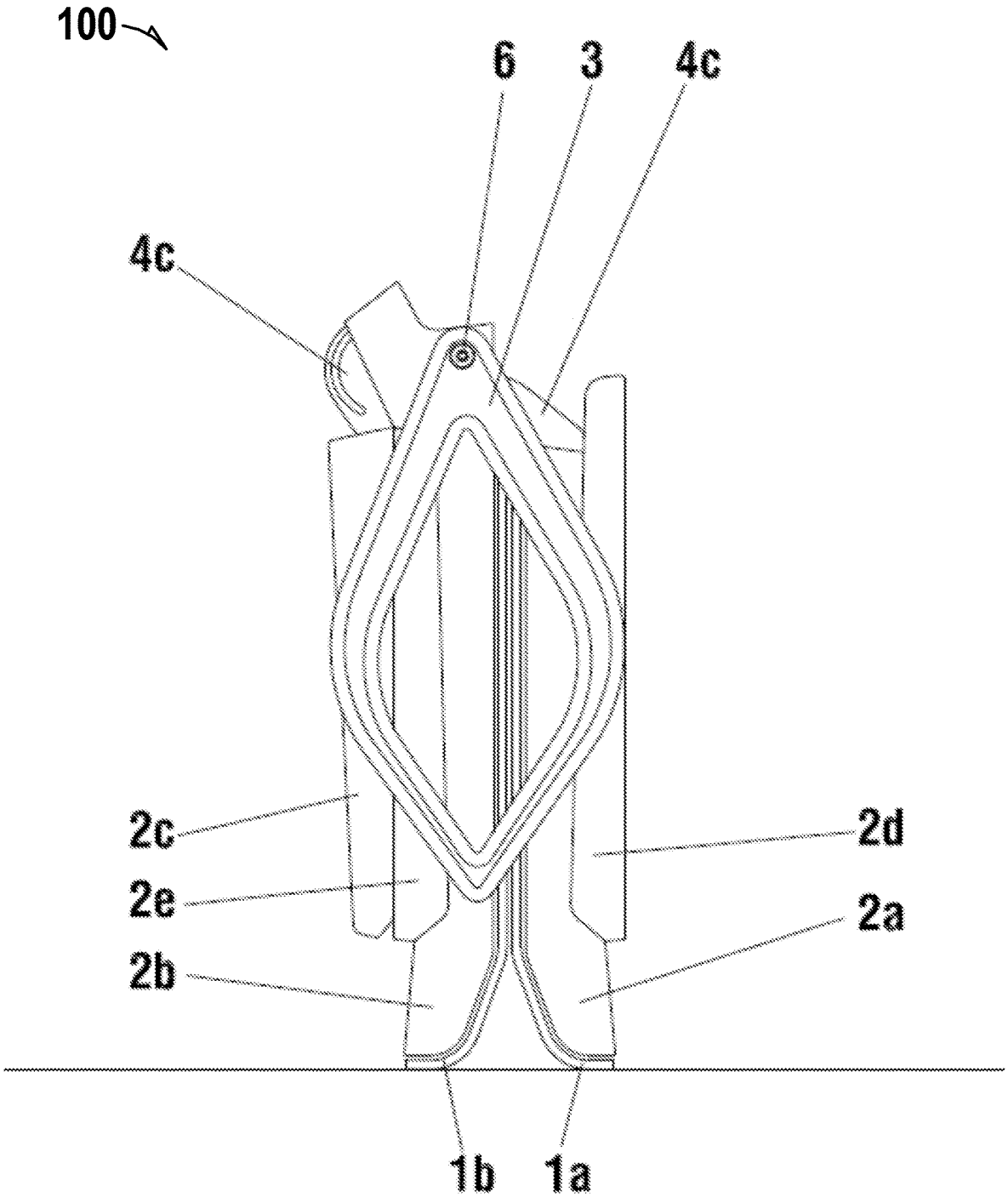
FIG. 17 shows a side view of the folding chair, consistent with some embodiments described herein, configured in a third "storage" mode.

FIG. 17 shows a side view of the folding chair 100, consistent with some embodiments described herein, configured in a third "storage" mode.

The folding chair 100 may be configured in a third mode for storage as follows. The second pair of legs 2*d* may be configured to be folded into the recess areas in the first frame 2*a*, the third pair of legs 2*e* may be configured to be folded into the recess areas in the second frame 2*b*, and the first pair of legs 2*c* may be configured to be folded together with the first pair of legs 2*c* or together with the third pair of legs 2*e*. The first frame 2*a* and the second frame 2*b* may be configured to be folded face-to-face against each other. The armrests 3 may be configured to be rotated to a neutral position (e.g., not rotated to either direction with respect to the first and second frames 2*a* and 2*b*). The armrests 3 may be secured to any of the frames 2*a* and 2*b* or any of the legs (e.g., of pairs 2*c*, 2*d* or 2*e*) using a locking mechanism, for example a locking pin.

Figure 18:
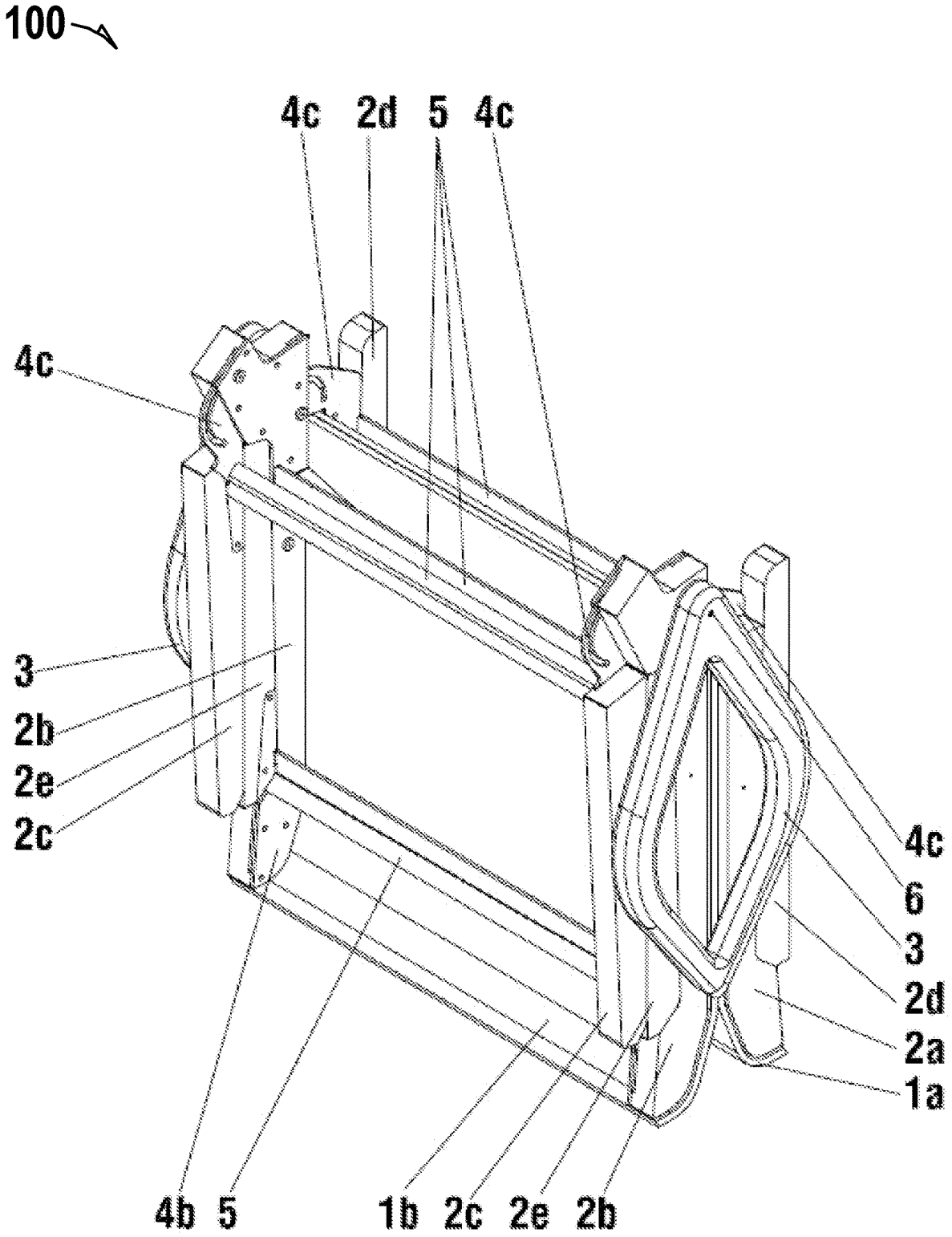
FIG. 18 shows an isometric view of the folding chair, consistent with some embodiments described herein, configured in the third "storage" mode.

FIG. 18 shows an isometric view of the folding chair 100, consistent with some embodiments described herein, configured in the third "storage" mode.

As shown in FIG. 18, the folding chair 100 may deploy the following component parts according to the storage configuration described above with respect to FIG. 17. The first and second supports 1*a* and 1*b* may be arranged in the first and second frames 2*a* and 2*b*, respectively. The armrests 3 may be rotatably connected (e.g., via respective hinges 6) to opposite sides of the joint assembly 4*c* that rotatably connects the first frame 2*a* to the second frame 2*b*. Each of the frames 2*a* and 2*b* and the pairs of legs 2*c*, 2*d* and 2*e* may include cross members 5 to provide lateral support or to act as compression elements. In some embodiments the cross members 5 may be integrated into the joint assemblies 4*a*, 4*b* or other rotatable connections of folding chair 100. Furthermore, each of the 6 legs may be deployed (e.g., via joint assemblies 4*a*-4*c* or other rotatable connections) in the third storage mode with respect to the first and second frames 2*a* and 2*b* as described above with respect to FIG. 18.

Figure 19A:
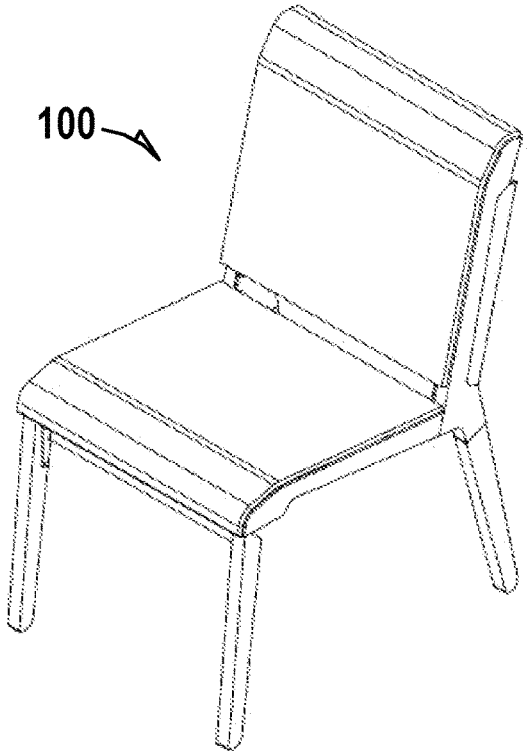
FIGS. 19A-19C show isometric views of the folding chair, consistent with some embodiments described herein, respectively configured in the first "dining" mode without armrests, the second "lounging" mode without the armrests and the third "storage" mode without the armrests.
Figure 19C:
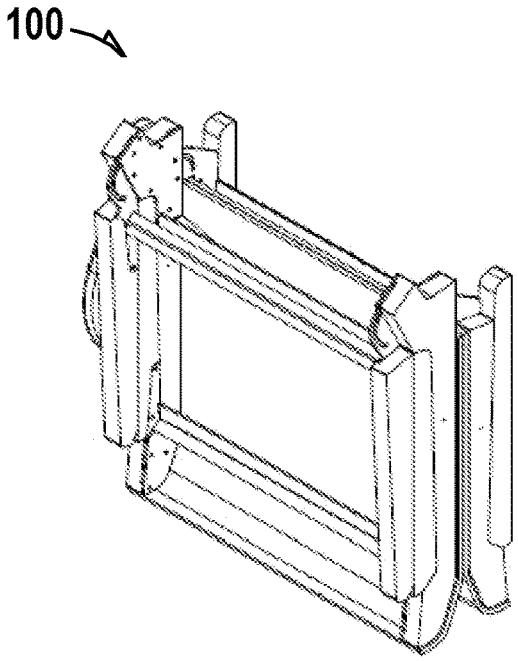
Figure 19B:
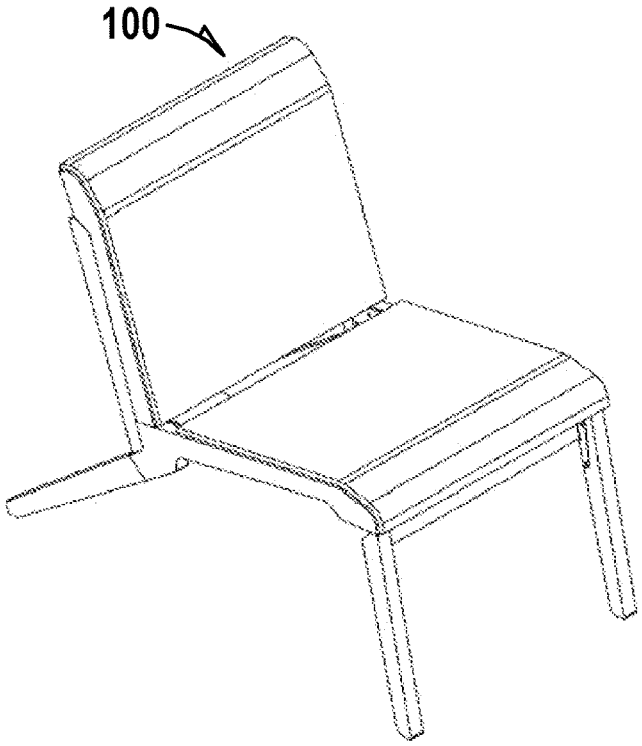

FIGS. 19A-19C show isometric views of the folding chair 100, consistent with some embodiments described herein, respectively configured in the first "dining" mode without armrests, the second "lounging" mode without the armrests and the third "storage" mode without the armrests.

As shown in FIGS. 19A-19C, the modular design of the folding chair 100 allows for deployment of the folding chair 100 according to all three modes of operation (e.g., first mode for dining in FIG. 19A, second mode for lounging in FIG. 19B, and third mode for storage in FIG. 19C) without the armrests 3 being attached.

FIGS. 20A-20C show side views of the rotatable connections between elements of the folding chair 100, consistent with some embodiments described herein.

As shown in FIGS. 20A-20C, the elements 2*a*-2*e* of the folding chair 100 may be rotatably attached to each other for deployment of the folding chair 100 according to all three modes of operation as discussed above. FIG. 20A shows the first support 1*a* arranged in the first frame 2*a* and the second pair of legs 2*d* rotatably attached to the first frame 2*a* via a joint assembly 4*a*. As noted above both the first frame 2*a* and the second pair of legs 2*d* may include cross members 5. FIG. 20B shows the second support 1*b* arranged in the second frame 2*b* and the third pair of legs 2*e* rotatably attached to the second frame 2*b* via a joint assembly 4*b*. As noted above both the second frame 2*b* and the third pair of legs 2*e* may include cross members 5. FIG. 20C shows the first support 1*a* arranged in the first frame 2*a* and the second support 1*b* arranged in the second frame 2*b*. The first frame 2*a* and the second frame 2*b* are rotatably connected via a joint assembly 4*c* and the first pair of legs 2*c* are rotatably attached to the second frame 2*b* via a joint assembly 4*c*. As noted above the first frame 2*a*, the second frame 2*b* and the first pair of legs 2*c* may include cross members 5.

Figure 21:
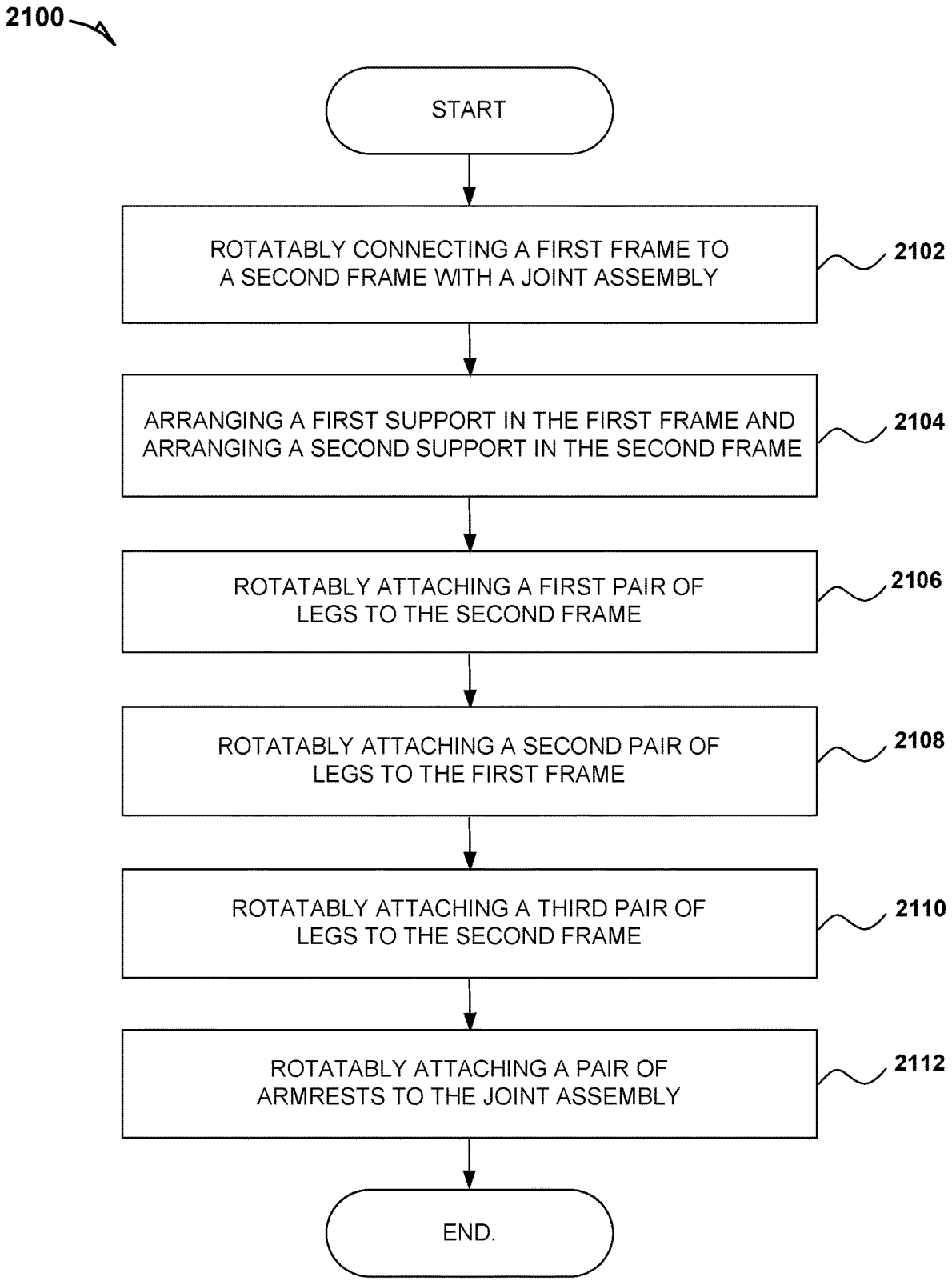
FIG. 21 shows a flow diagram of a method for configuring the folding chair, consistent with some embodiments described herein.

FIG. 21 shows a flow diagram of a method 2100 for configuring the folding chair 100, consistent with some embodiments described herein.

The method 2100 may start and at 2102 a first frame (e.g., first frame 2*a*) may be rotatably connected to a second frame (e.g., second frame 2*b*) with a joint assembly (e.g., joint assembly 4), wherein each frame includes a plurality of cross members (e.g., cross member 5).

At 2104, a first support (e.g., support 1*a*) may be arranged in the first frame 2*a* and a second support 1*b* may be arranged in the second frame 2*b*.

At 2106, a first pair of legs (e.g., legs 2*c*) may be rotatably attached to the second frame 2*b* (e.g., via a joint assembly 4*c* or other such rotatable connection).

At 2108, a second pair of legs (e.g., legs 2*d*) may be rotatably attached to the first frame 2*a* (e.g., via a joint assembly 4*c* or other such rotatable connection).

At 2110, a third pair of legs (e.g., legs 2*e*) may be rotatably attached to the second frame 2*b*.

At 2112, a pair of armrests (e.g., armrests 3) may be rotatably attached to the joint assembly 4. The method 2100 may then end with folding chair 100 ready to be deployed in any of the modes of operation (e.g., dining, lounging or storage) as described above.

Figure 22:
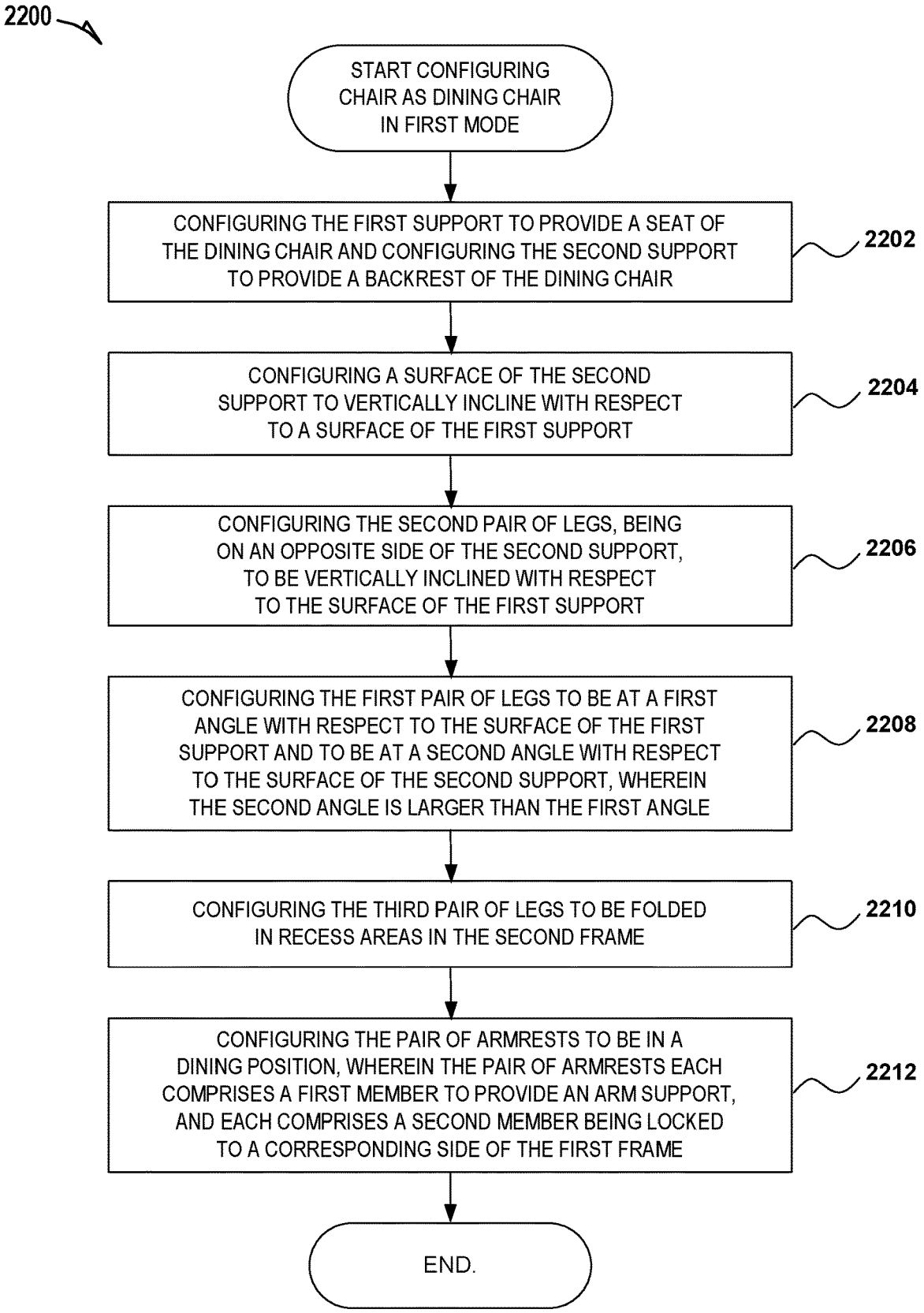
FIG. 22 shows a flow diagram of a method for configuring the folding chair in the first "dining" mode, consistent with some embodiments described herein.

FIG. 22 shows a flow diagram of a method 2200 for configuring the folding chair 100 in the first "dining" mode, consistent with some embodiments described herein.

The method 2200 may start configuring folding chair 100 as a dining chair and at 2202 the first support 1*a* may be configured to provide a seat of the dining chair and the second support 1*b* may be configured to provide a backrest of the dining chair.

At 2204, a surface of the second support 1*b* may be configured to vertically incline with respect to a surface of the first support 1*a*.

At 2206, the second pair of legs 2*d*, being on an opposite side of the second support 1*b*, may be configured to be vertically inclined with respect to the surface of the first support 1*a;*

At 2208, the first pair of legs 2*c* may be configured to be at a first angle with respect to the surface of the first support 1*a* and to be at a second angle with respect to the surface of the second support 1*b*, wherein the second angle is larger than the first angle.

At 2210, the third pair of legs 2*e* may be configured to be folded in recess areas in the second frame 2*b*.

At 2212, the pair of armrests 3 may be configured to be in a dining position, wherein the pair of armrests 3 each includes a first member to provide an arm support (e.g., for a sitting user of folding chair 100), and each includes a second member being locked to a corresponding side of the first frame 1*a* (e.g., via locking mechanisms 7*a*). The method 2200 may then end with folding chair 100 deployed in the first mode for dining as described above.

Figure 23:
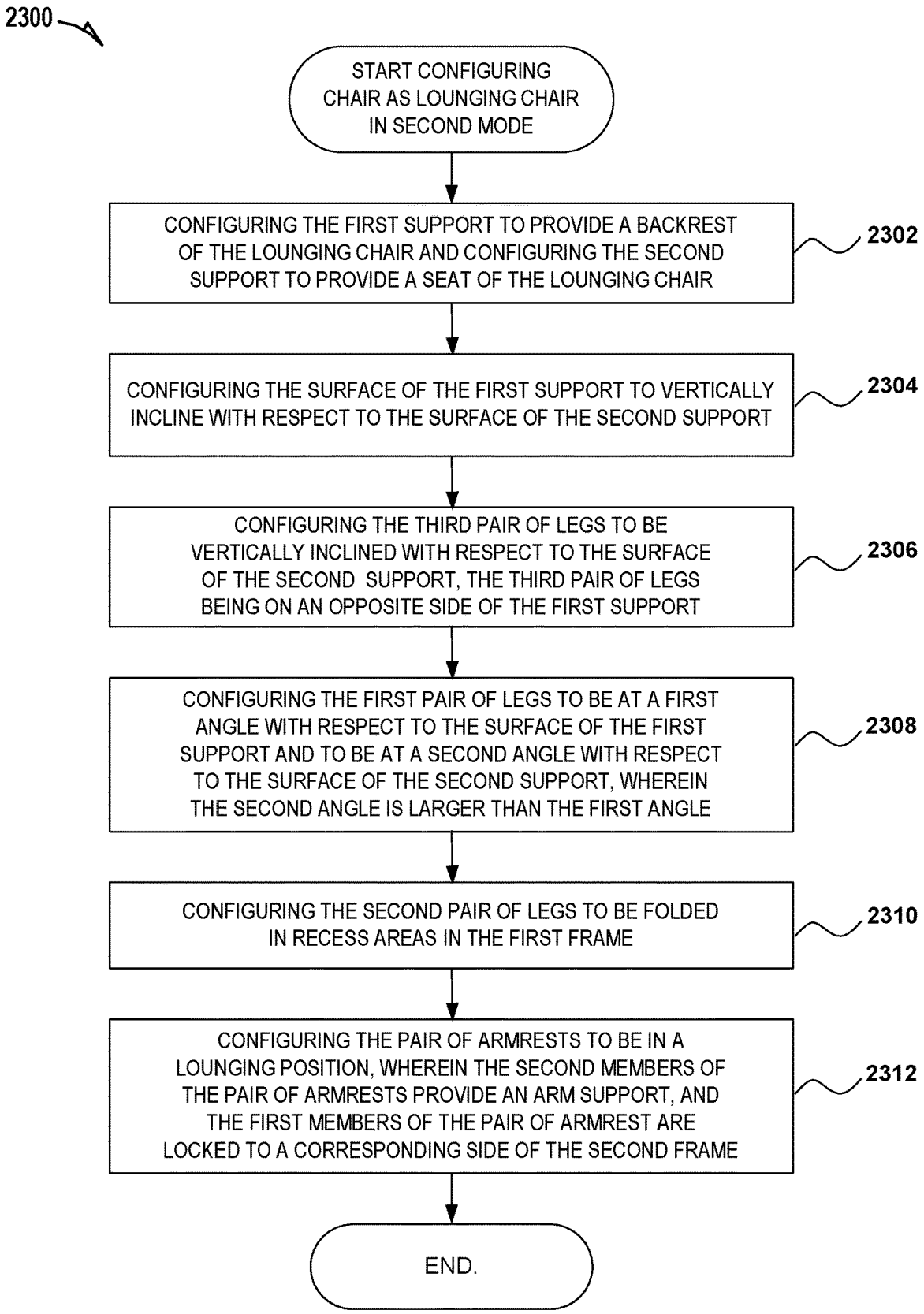
FIG. 23 shows a flow diagram of a method for configuring the folding chair in the second "lounging" mode, consistent with some embodiments described herein.

FIG. 23 shows a flow diagram of a method for configuring the folding chair 100 in the second "lounging" mode, consistent with some embodiments described herein.

The method 2300 may start configuring folding chair 100 as a lounging chair and at 2302 the first support 1*a* may be configured to provide a backrest of the lounging chair and the second support 1*b* may be configured to provide a seat of the lounging chair.

At 2304, the surface of the first support 1*a* may be configured to vertically incline with respect to the surface of the second support 1*b*.

At 2306, the third pair of legs 2*e* may be configured to be vertically inclined with respect to the surface of the second support 1*b*, the third pair of legs 2*e* being on an opposite side of the first support 1*a*.

At 2308, the first pair of legs 2*c* may be configured to be at a first angle with respect to the surface of the first support 1*a* and to be at a second angle with respect to the surface of the second support 1*b*, wherein the second angle is larger than the first angle.

At 2310, the second pair of legs 2*d* may be configured to be folded in recess areas in the first frame 2*a*.

At 2312, the pair of armrests 3 may be configured to be in a lounging position, wherein the second members of the pair of armrests 3 provide an arm support (e.g., for a sitting user of folding chair 100), and the first members of the pair of armrests are locked to a corresponding side of the second frame 1*b* (e.g., via locking mechanisms 7*b*). The method 2300 may then end with folding chair 100 deployed in the second mode for lounging as described above.

Figure 24:
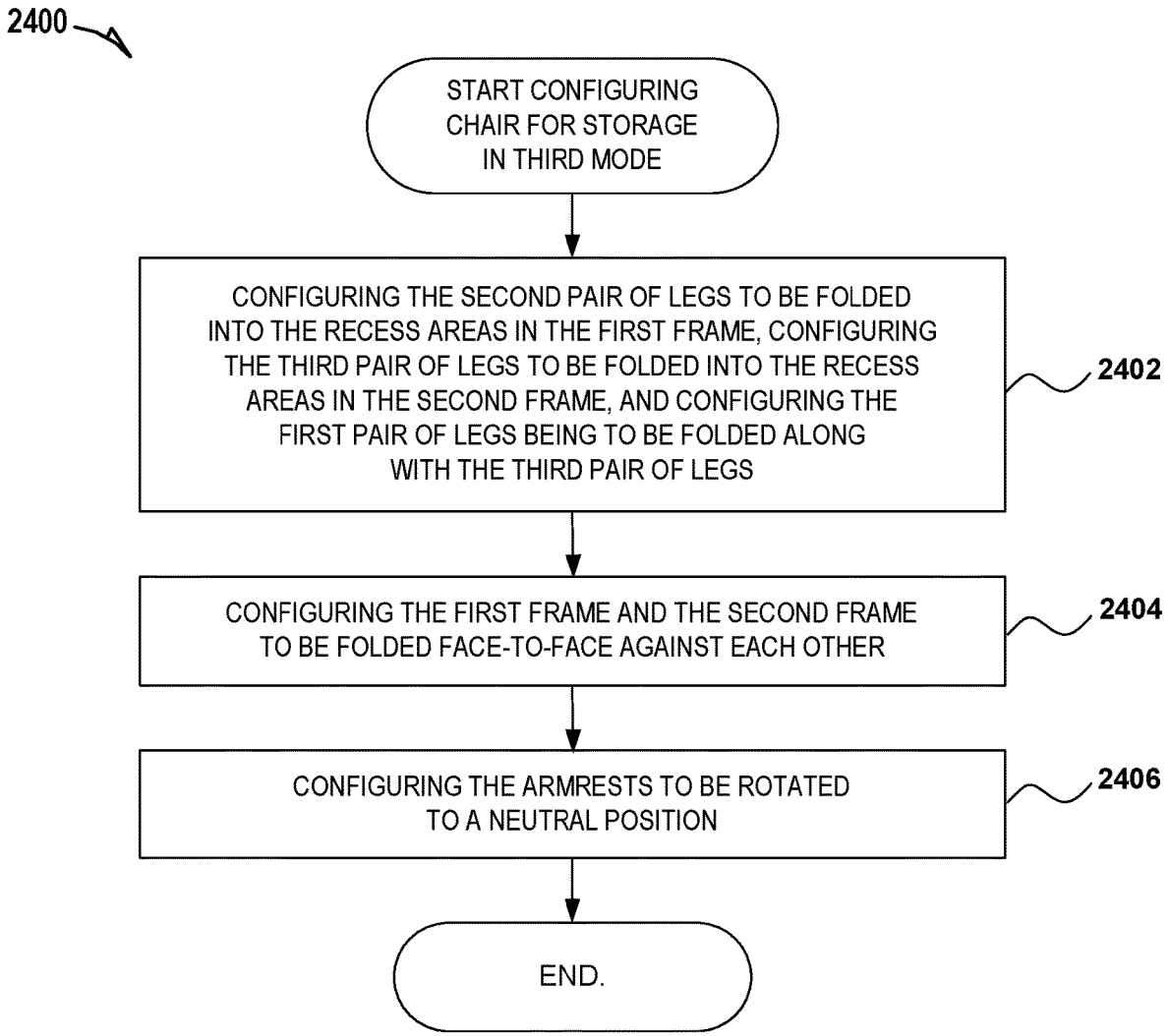
FIG. 24 shows a flow diagram of a method for configuring the folding chair in the third "storage" mode, consistent with some embodiments described herein.

FIG. 24 shows a flow diagram of a method 2400 for configuring the folding chair 100 in the third "storage" mode, consistent with some embodiments described herein The method 2400 may start configuring folding chair 100 for storage and then at 2402 the second pair of legs 2*d* may be configured to be folded into the recess areas in the first frame 2*a*, the third pair of legs 2*e* may be configured to be folded into the recess areas in the second frame 2*b*, and the first pair of legs 2*c* may be configured to be folded together with the third pair of legs 2*e*.

At 2404, the first frame 2*a* and the second frame 2*b* may be configured to be folded face-to-face against each other.

At 2406 the armrests 3 may be configured to be rotated to a neutral position. The method 2400 may then end with folding chair 100 deployed in the third mode for storage as described above.

Language:

In the foregoing descriptions, numerous details are set forth. It will be apparent, however, to one of ordinary skill in the art, that the present disclosure may be practiced without all of these specific details.

The words "example" or "exemplary" are used herein to mean serving as an example, instance, or illustration. Any aspect or design described herein as "example' or "exemplary" is not necessarily to be construed as preferred or advantageous over other aspects or designs. As used in this disclosure, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "one embodiment" or "an implementation" or "one implementation" throughout is not intended to mean the same embodiment or implementation unless described as such.

It is to be understood that the above description is intended to be illustrative, and not restrictive. Many other embodiments/implementations will be apparent to those of skill in the art upon reading and understanding the above description. The scope of the disclosure should, therefore, be determined with reference to the appended claims, along with the full scope of equivalents to said claims.

The invention claimed is:

1. A folding chair, comprising:

a first frame and a second frame;

a joint assembly to rotatably connect the first frame with the second frame;

a first support and a second support, wherein the first support is arranged in the first frame and the second support is arranged in the second frame;

six legs comprising a first pair of legs rotatably attached to the second frame, a second pair of legs rotatably attached to the first frame, and a third pair of legs rotatably attached to the second frame; and a pair of armrests rotatably attached directly to the joint assembly.

2. The folding chair of claim 1, further comprising three modes:

a first mode, wherein the folding chair is configured as a dining chair;

a second mode, wherein the folding chair is configured as a lounging chair; and a third mode wherein the folding chair is configured for compact storage.

3. The folding chair of claim 2, wherein the first mode comprises:

the first support being configured to provide a seat of the dining chair and the second support being configured to provide a backrest of the dining chair;

a surface of the second support being configured to vertically incline with respect to a surface of the first support;

the second pair of legs, being on an opposite side of the second support, being configured to be vertically inclined with respect to the surface of the first support;

the first pair of legs being configured to be at a first angle with respect to the surface of the first support and to be at a second angle with respect to the surface of the second support, wherein the second angle is larger than the first angle;

the third pair of legs being configured to be folded in recess areas in the second frame; and the pair of armrests being configured to be in a dining position, wherein the pair of armrests each comprises a first member to provide an arm support, and each comprises a second member being locked to a corresponding side of the first frame.

4. The folding chair of the claim 2, wherein the second mode comprises:

the first support being configured to provide a backrest of the lounging chair and the second support being configured to provide a seat of the lounging chair;

the surface of the first support being configured to vertically incline with respect to the surface of the second support;

the third pair of legs being configured to be vertically inclined with respect to the surface of the second support, the third pair of legs being on an opposite side of the first support;

the first pair of legs being configured to be at a first angle with respect to the surface of the first support and to be at a second angle with respect to the surface of the second support, wherein the second angle is larger than the first angle;

the second pair of legs being configured to be folded in recess areas in the first frame; and the pair of armrests being configured to be in a lounging position, wherein the second members of the pair of armrests provide an arm support, and the first members of the pair of armrests are locked to a corresponding side of the second frame.

5. The folding chair of claim 2, wherein the third mode comprises:

the second pair of legs being configured to be folded into the recess areas in the first frame, the third pair of legs being configured to be folded into the recess areas in the second frame, and the first pair of legs being configured to be folded along with the third pair of legs;

the first frame and the second frame being configured to be folded face-to-face against each other; and the armrests being configured to be rotated to a neutral position.

6. The folding chair of claim 1, wherein the first pair of legs have an identical first length, the second pair of legs have an identical second length, and the third pair of legs have an identical third length, and wherein the second length is greater than the third length.

7. The folding chair of claim 1, wherein the first frame and the second frame are made of a solid material, and wherein the solid material is one of wood, metal, plastic, or another type of material.

8. The folding chair of claim 1, wherein the folding chair is a modular design, and wherein the first support and the second support have an identical body shape.

9. The folding chair of claim 1, wherein the first support is one of removably or fixedly arranged in the first frame and the second support is one of removably or fixedly arranged in the second frame.

10. The folding chair of claim 1, wherein each of the pair of armrests is attached to the joint assembly using a hinge, and wherein each side of the first frame or the second frame includes a lock mechanism to lock the corresponding armrest into position in the first mode or the second mode.

11. The folding chair of claim 1, wherein the pair of armrests are made of a solid material and wherein the solid material is one of wood, metal, or plastic.

12. The folding chair of claim 1, wherein the supports are made of fabric, leather, plastic, rubber, or wood.

13. A method for providing a folding chair of claim 1, comprising:

rotatably connecting the first frame to the second frame with a joint assembly;

arranging a first support in the first frame and arranging a second support in the second frame;

rotatably attaching a first pair of legs to the second frame;

rotatably attaching a second pair of legs to the first frame;

rotatably attaching a third pair of legs to the second frame; and rotatably attaching a pair of armrests to the joint assembly.

14. The method of claim 13, further comprising:

configuring the folding chair as a dining chair in a first mode;

configuring the folding chair as a lounging chair in a second mode; and configuring the folding chair for compact storage in a third mode.

15. The method of claim 14, wherein the first mode comprises:

configuring the first support to provide a seat of the dining chair and configuring the second support to provide a backrest of the dining chair;

configuring a surface of the second support to vertically incline with respect to a surface of the first support;

configuring the second pair of legs, being on an opposite side of the second support, to be vertically inclined with respect to the surface of the first support;

configuring the first pair of legs to be at a first angle with respect to the surface of the first support and to be at a second angle with respect to the surface of the second support, wherein the second angle is larger than the first angle;

configuring the third pair of legs to be folded in recess areas in the second frame; and configuring the pair of armrests to be in a dining position, wherein the pair of armrests each comprises a first member to provide an arm support, and each comprises a second member being locked to a corresponding side of the first frame.

16. The method of claim 14, wherein the second mode comprises:

configuring the first support to provide a backrest of the lounging chair and configuring the second support to provide a seat of the lounging chair;

configuring the surface of the first support to vertically incline with respect to the surface of the second support;

configuring the third pair of legs to be vertically inclined with respect to the surface of the second support, the third pair of legs being on an opposite side of the first support;

configuring the first pair of legs to be at a first angle with respect to the surface of the first support and to be at a second angle with respect to the surface of the second support, wherein the second angle is larger than the first angle;

configuring the second pair of legs to be folded in recess areas in the first frame; and configuring the pair of armrests to be in a lounging position, wherein the second members of the pair of armrests provide an arm support, and the first members of the pair of armrests are locked to a corresponding side of the second frame.

17. The method of claim 14, wherein the third mode comprises:

configuring the second pair of legs to be folded into the recess areas in the first frame, configuring the third pair of legs to be folded into the recess areas in the second frame, and configuring the first pair of legs being to be folded along with the third pair of legs;

configuring the first frame and the second frame to be folded face-to-face against each other; and configuring the armrests to be rotated to a neutral position.

18. The method of claim 13, wherein the first pair of legs have an identical first length, the second pair of legs have an identical second length, and the third pair of legs have an identical third length, and wherein the second length is greater than the third length.

19. The method of claim 13, wherein:

the first frame and the second frame are made of a solid material, and wherein the solid material is one of wood, metal, plastic, or another type of material; and the pair of armrests are made of a solid material and wherein the solid material is one of wood, metal, or plastic.

20. The method of claim 13, wherein the first support is one of removably or fixedly arranged in the first frame and the second support is one of removably or fixedly arranged in the second frame.

* * * * *